US012318650B1

(12) United States Patent
Hu

(10) Patent No.: US 12,318,650 B1
(45) Date of Patent: Jun. 3, 2025

(54) LOCKING MECHANISM FOR DUMBBELL AND DUMBBELL USING THE SAME

(71) Applicant: Yongkang Qifeng Industry and Trade Co., Ltd., Zhejiang (CN)

(72) Inventor: Lingying Hu, Zhejiang (CN)

( * ) Notice: Subject to any disclaimer, the term of this patent is extended or adjusted under 35 U.S.C. 154(b) by 0 days.

(21) Appl. No.: 18/736,103

(22) Filed: Jun. 6, 2024

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 21/072–075
See application file for complete search history.

(56) References Cited

U.S. PATENT DOCUMENTS 12,076,605 B2 * 9/2024 Sun ..... A63B 21/075
2004/0005968 A1 * 1/2004 Crawford ..... A63B 21/0607 482/106
2008/0026921 A1 * 1/2008 Liu ..... A63B 21/075 482/107
2015/0360073 A1 * 12/2015 Moran ..... A63B 21/075
2015/0367163 A1 * 12/2015 Moran ..... A63B 71/0036 482/108
2017/0001061 A1 * 1/2017 Marjama ..... A63B 71/0036
2017/0239510 A1 * 8/2017 Wang ..... A63B 21/0724
2022/0047908 A1 * 2/2022 Weng ..... A63B 21/0728

* cited by examiner

*Primary Examiner* — Loan B Jimenez
*Assistant Examiner* — Catrina A Letterman
(74) *Attorney, Agent, or Firm* — Hawaii Patent Services; Nathaniel K. Fedde; Kenton N. Fedde

(57) ABSTRACT

A dumbbell comprises a dumbbell body, a base and a locking mechanism, wherein the dumbbell body comprises a handle and a plurality of weight plates, a plate selection mechanism is arranged between the handle and the weight plates, and plate selection mechanism locks the weight plates by rotating the handle; when the weight plates are locked by the plate selection mechanism, the locking mechanism is in a released state, and when the weight plates are not locked by the plate selection mechanism, the locking mechanism is in a locked state.

19 Claims, 16 Drawing Sheets

B

C

LOCKING MECHANISM FOR DUMBBELL AND DUMBBELL USING THE SAME

TECHNICAL FIELD

The present invention relates to the technical field of fitness equipment, in particular to a locking mechanism for a dumbbell and a dumbbell using the same.

BACKGROUND

Dumbbell is a widely used fitness equipment, which can be used to exercise arm muscle strength. The existing dumbbells are generally dumbbells with weight plates. However, when the existing dumbbell is separated from the base, it is impossible to confirm whether the weight plate is locked in place. If the weight plate is not locked in place, take the dumbbell for exercise, and the weight plate is likely to fall during exercise, and the weight selection is inaccurate. Therefore, the existing dumbbell has the risk of weight plate falling, which is easy to cause safety accidents and the exercise effect is difficult to achieve. For example, the dumbbells disclosed in U.S. Pat. Nos. 10,022,583 and 11,167,167 have the above problems, and it is impossible to confirm whether the weight plates are locked in place, which has potential safety hazards.

Based on this, it is necessary to provide a new type of dumbbell, which can ensure that the weight plate is locked by the dumbbell and will not fall off the base, with high safety and high accuracy in weight selection, and can give users a safer and more secure dumbbell exercise experience.

SUMMARY

The present invention provides a locking mechanism for a dumbbell, which includes a locking part and a locking groove arranged in a base, wherein the locking part is movably connected with the base; the locking part comprises a locking member and a locking disk; a rotating cavity and an accommodating cavity are arranged in the locking part; an elastic member and a first opening are arranged in the accommodating cavity; the accommodating cavity and the rotating cavity are communicated through the first opening; a first rotating shaft is arranged in the rotating cavity, and the locking disk is rotatably arranged on the first rotating shaft; a second rotating shaft is arranged in the accommodating cavity, and the locking member is rotatably arranged on the second rotating shaft, wherein the first rotating shaft is relatively perpendicular to the second rotating shaft; and the locking disk comprises a plurality of locking protrusions and positioning grooves, and the locking member comprises a locking hook and a locking block, wherein at least part of the locking disk is located in the accommodating cavity through the first opening, and the locking block elastically abuts against the locking protrusions or the clamping grooves through the elastic member; and the positioning grooves are used for receiving the locking hook and locking the locking part.

The present invention further provides a dumbbell, which includes a dumbbell body, a base and a locking mechanism arranged on the dumbbell body and the base, wherein the dumbbell body comprises a handle and a plurality of weight plates symmetrically arranged at two ends of the handle; a plate selection mechanism is arranged between the handle and the weight plates, and the plate selection mechanism locks the weight plates by rotating the handle; and the locking mechanism comprises a locking part and a locking groove arranged in the base, wherein the locking part is movably connected with the base; the locking part comprises a locking member and a locking disk; a rotating cavity and an accommodating cavity are arranged in the locking part; an elastic member and a first opening are arranged in the accommodating cavity; the accommodating cavity and the rotating cavity are communicated through the first opening; a first rotating shaft is arranged in the rotating cavity, the locking disk is rotatably arranged on the first rotating shaft, and the locking disk rotates synchronously with the handle; a second rotating shaft is arranged in the accommodating cavity, and the locking member is rotatably arranged on the second rotating shaft, wherein the first rotating shaft is relatively perpendicular to the second rotating shaft; and the locking disk comprises a plurality of locking protrusions and positioning grooves, and the locking member comprises a locking hook and a locking block, wherein at least part of the locking disk is located in the accommodating cavity through the first opening, and the locking block elastically abuts against the locking protrusions or the clamping grooves through the elastic member; and the positioning grooves are used for receiving the locking hook and locking the dumbbell body.

Dumbbell body (1000); Handle (1100); Weight plate (1200); second plate selection bump (1210); second plate selection groove (1220); Engaging groove (1230); Plate selection mechanism (1300); Driving rod (1310); Limiting disk (1320); Base (2000); Weight plate groove (2100); Engaging strip (2110); Locking part groove (2200); Upper flange (2300); Guide table (2400); Guide slope (2410); Locking mechanism (3000); Locking part (3100); Locking member (3110); Locking hook (3111); Locking block (3112); Rotating shaft hole (3113); Elastic groove (3114); Locking disk (3120); Locking protrusion (3121); Positioning groove (3122); Rotating cavity (3130); First rotating shaft (3131); Rotating groove (3132); Rotating cover (3133); Inscribed groove (3134); Rim part (3135); First driving part (3136); Rotating part (3137); Second driving part (3138); Rim groove (3139); Accommodating cavity (3140); Elastic member (3141); First opening (3142); Second rotating shaft (3143); Accommodating groove (3144); Accommodating cover (3145); Second opening (3146); Buckling protrusion (3147); Buckling groove (3148);

Embedding groove (3149); First shaft clamping groove (3150); Embedded protrusion (3151); Second shaft clamping groove (3152); First driving groove (3160); First limiting protrusion (3161); First limiting groove (3162); Linkage block (3163); Linkage hole (3164); Clamping groove (3165); Rotating hole (3170); Clamping protrusion (3171); Limiting part (3180); Limiting clamping groove (3181); tail disk (3190); Through hole (3191); Locking groove (3200).

DESCRIPTION OF EMBODIMENTS

Figure 1:
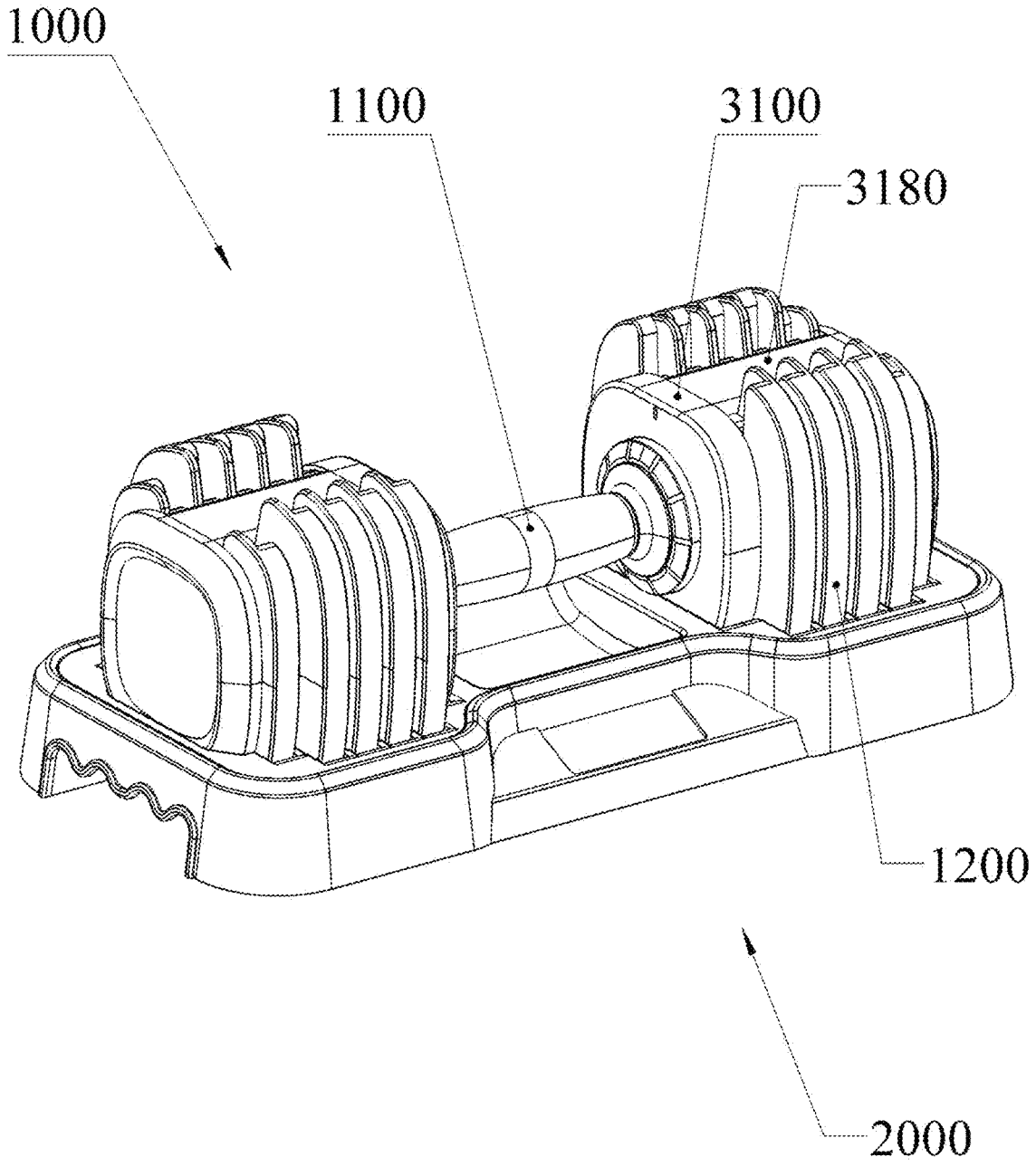
FIG. 1 is a schematic diagram of a dumbbell.
Figure 3:
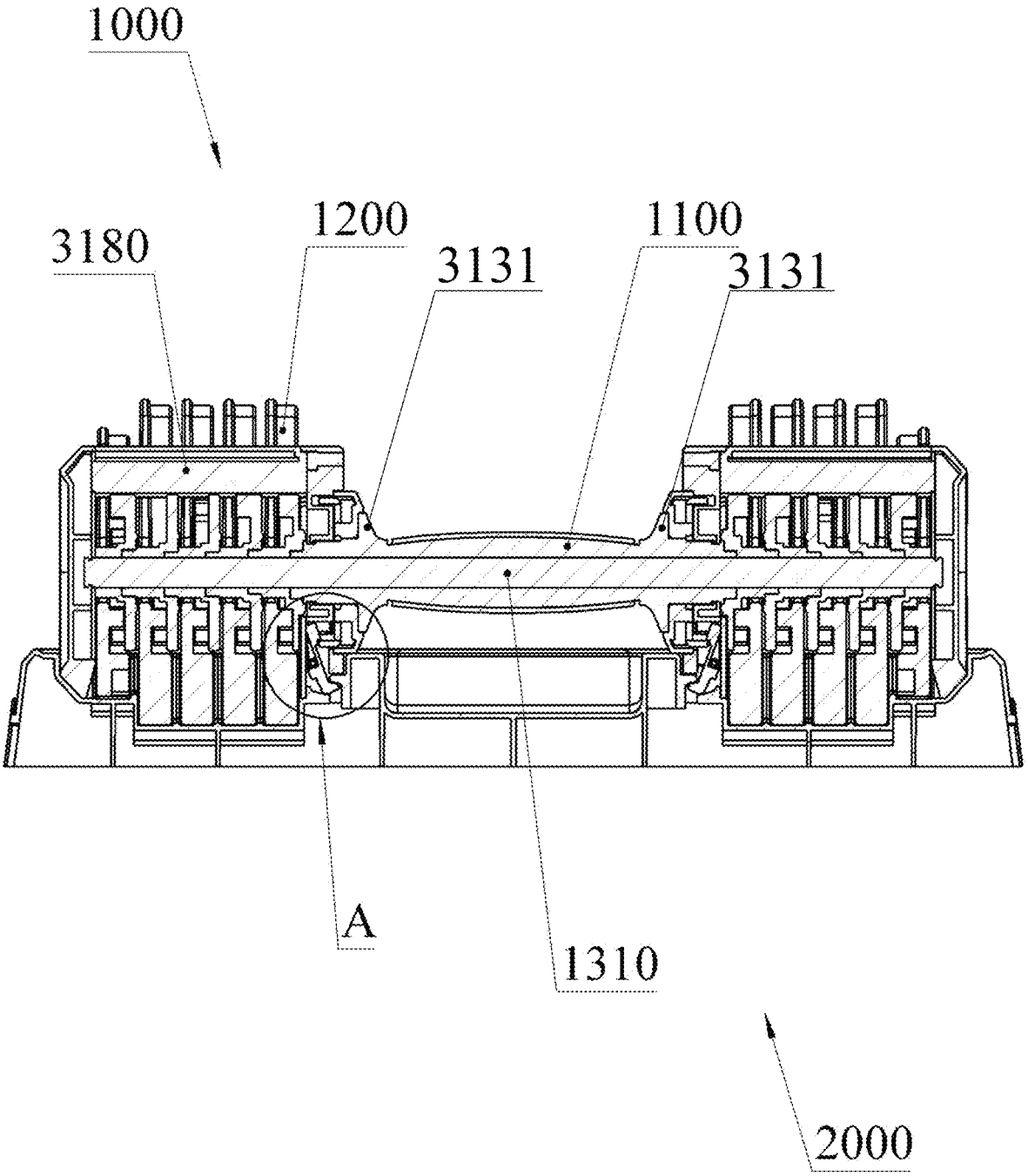
FIG. 3 is a sectional view of FIG. 1.
Figure 4:
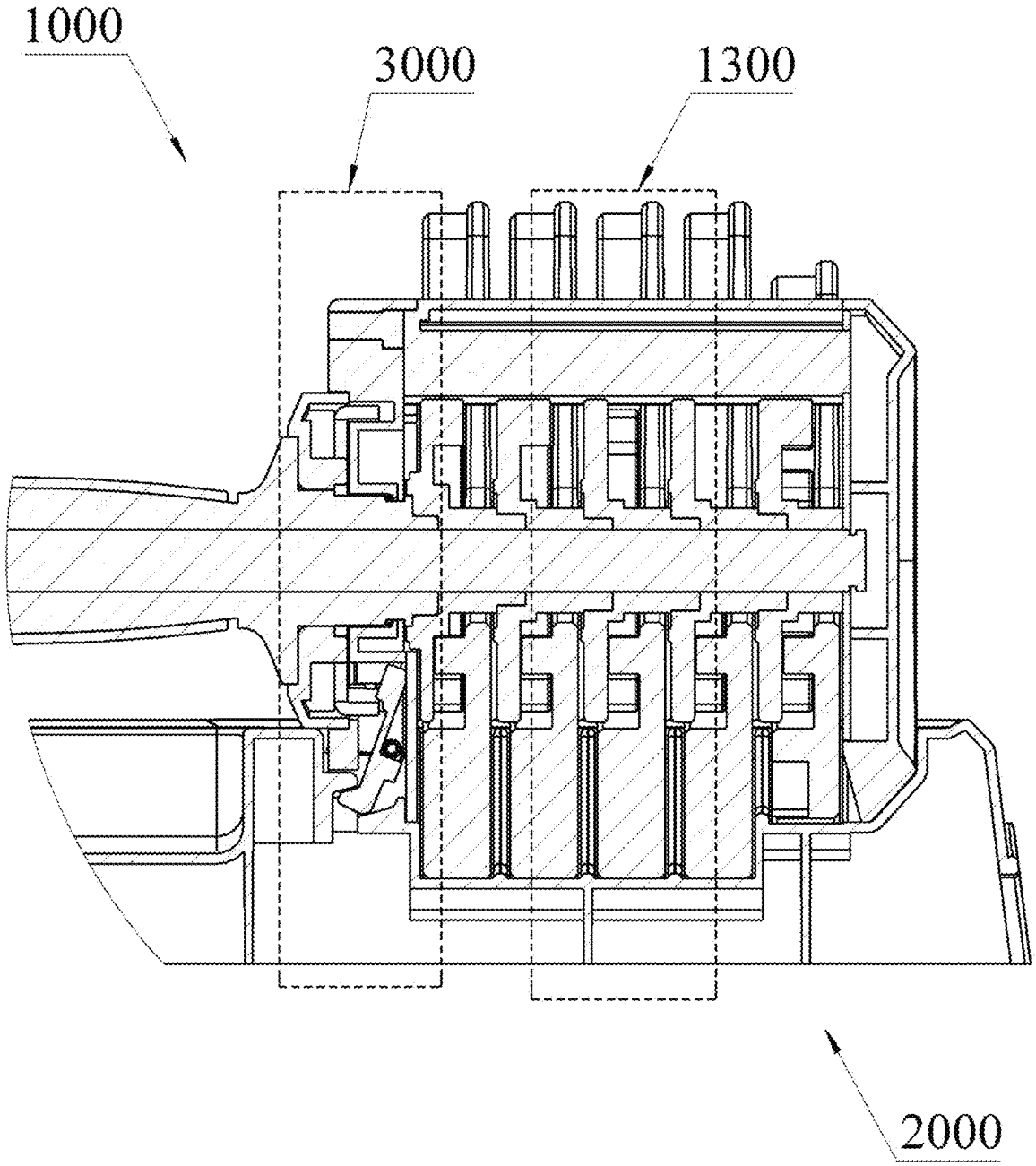
FIG. 4 is a partial schematic view of FIG. 3.

As shown in FIGS. 1, 3 and 4, the present invention provides a dumbbell, which includes a dumbbell body 1000, a base 2000, and locking mechanisms 3000 arranged on the dumbbell body 1000 and the base 2000. The dumbbell body 1000 includes a handle 1100 and a plurality of weight plates 1200 symmetrically arranged at the two ends of the handle 1100, and a plate selection mechanism 1300 is arranged between the handle 1100 and the weight plates 1200, and the plate selection mechanism 1300 locks the weight plates 1200 by rotating the handle 1100.

Figure 2:
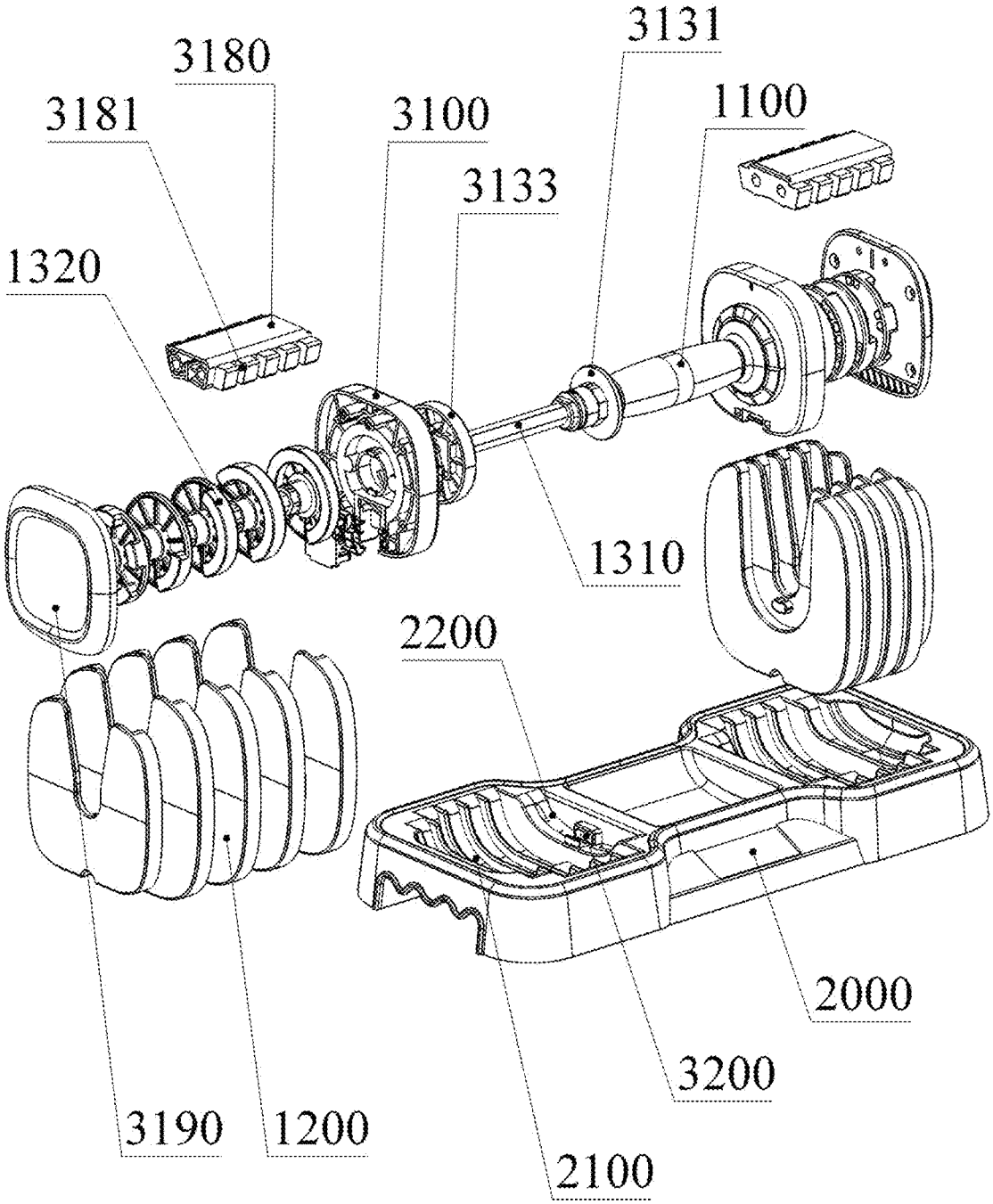
FIG. 2 is an exploded view of FIG. 1.
Figure 5:
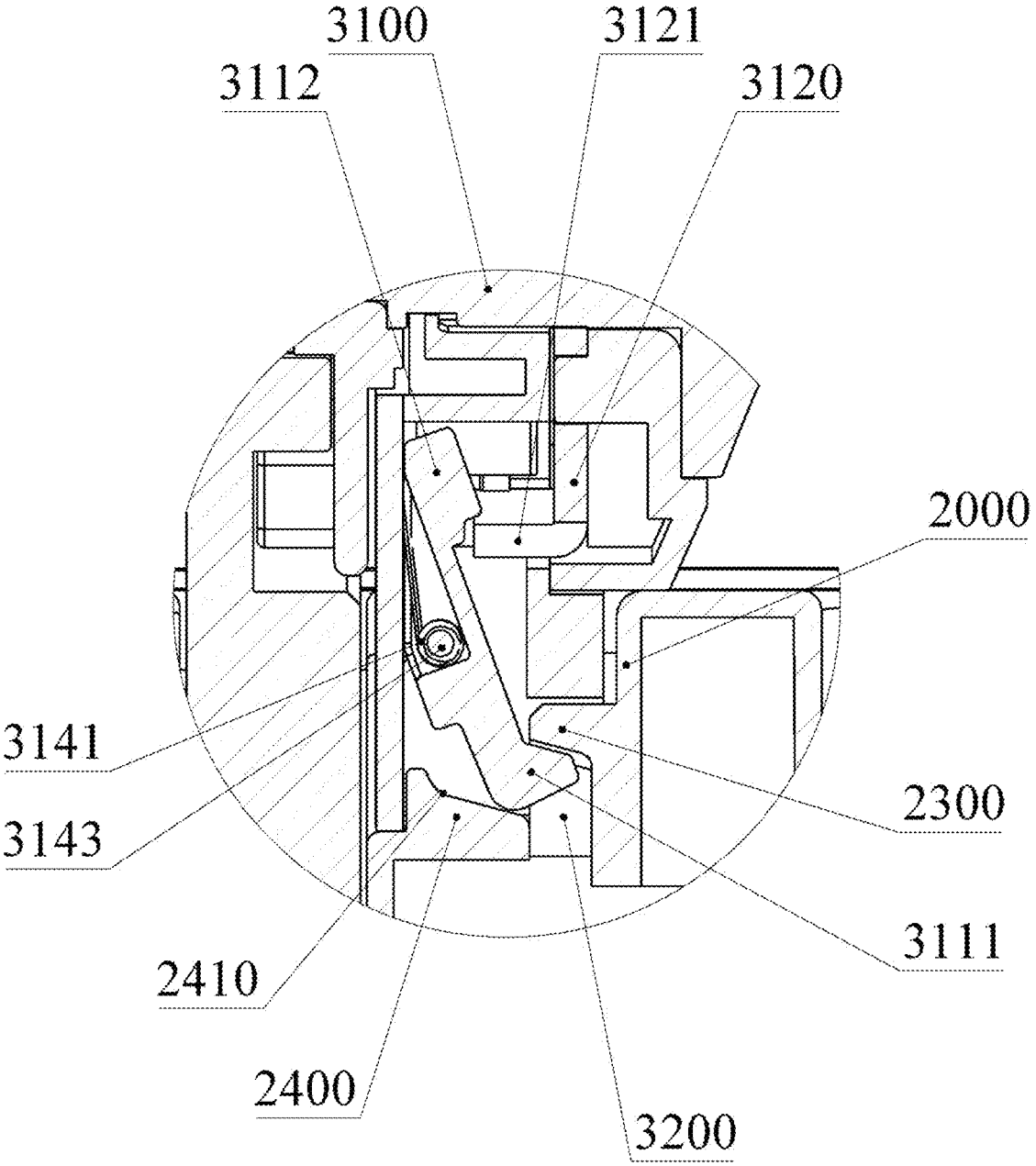
FIG. 5 is an enlarged schematic view at A in FIG. 3.
Figure 6:
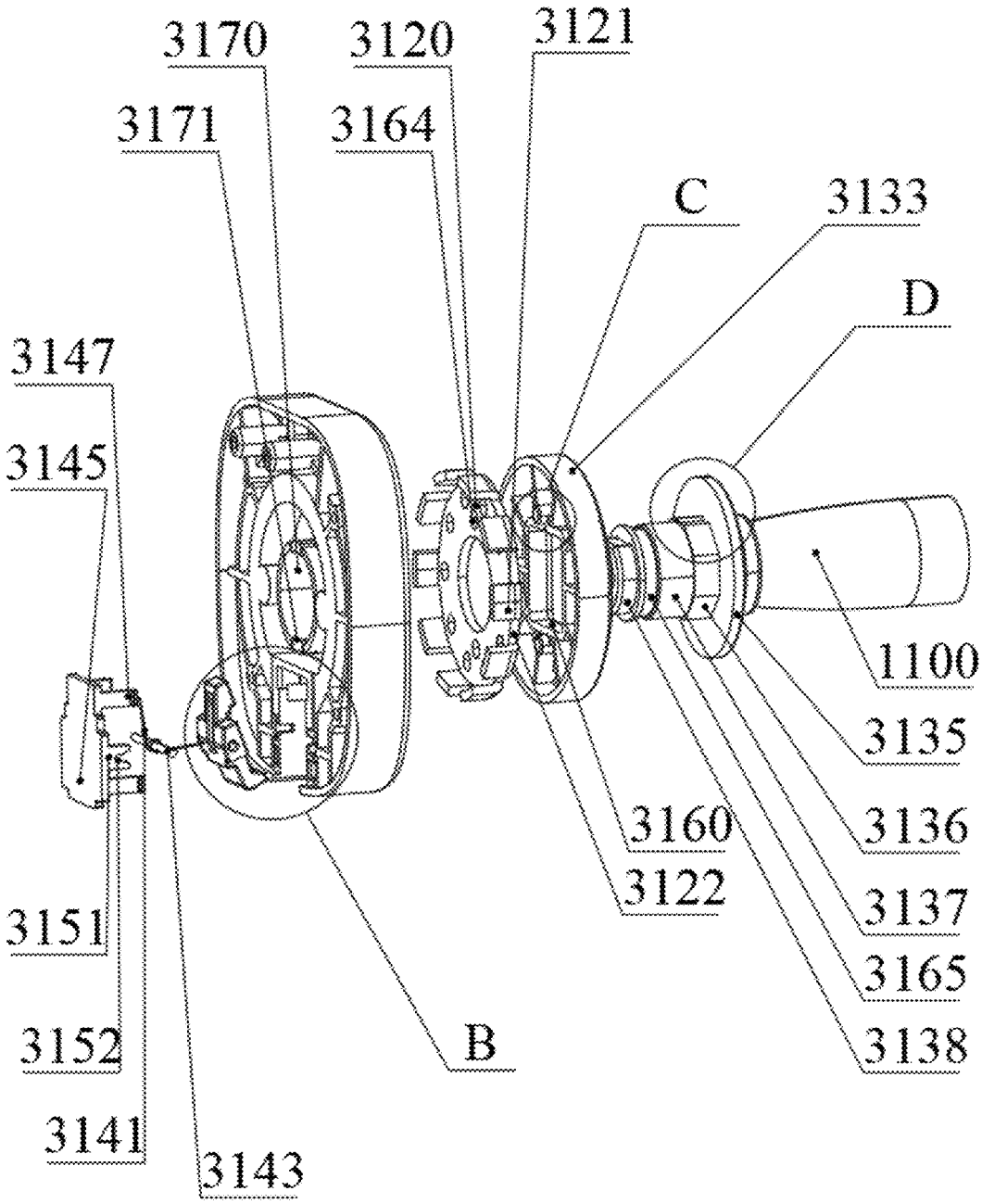
FIG. 6 is a partial explosion of dumbbell.

As shown in FIG. 2, the locking mechanism 3000 includes a locking part 3100 and a locking groove 3200 arranged in the base 2000; the locking part 3100 is fixedly connected to the handle 1100. As shown in FIG. 6, the locking part 3100 includes a locking member 3110 and a locking disk 3120. As shown in FIG. 9, a rotating cavity 3130 and an accommodating cavity 3140 are arranged in the locking part 3100, and an elastic member 3141 (see FIG. 5 and FIG. 6) and a first opening 3142 (see FIG. 7 and FIG. 8) are arranged in the accommodating cavity 3140. The accommodating cavity 3140 and the rotating cavity 3130 are communicated through the first opening 3142, and a first rotating shaft 3131 is arranged in the rotating cavity 3130 (see FIG. 7). The locking disk 3120 is rotatably arranged on the first rotating shaft 3131. The locking disk 3120 rotates synchronously with the handle 1100, and a second rotating shaft 3143 is arranged in the accommodating cavity 3140, and the locking member 3110 is rotatably arranged on the second rotating shaft 3143 (see FIG. 6 and FIG. 8), wherein the first rotating shaft 3131 is relatively perpendicular to and the second rotating shaft 3143.

Figure 8:
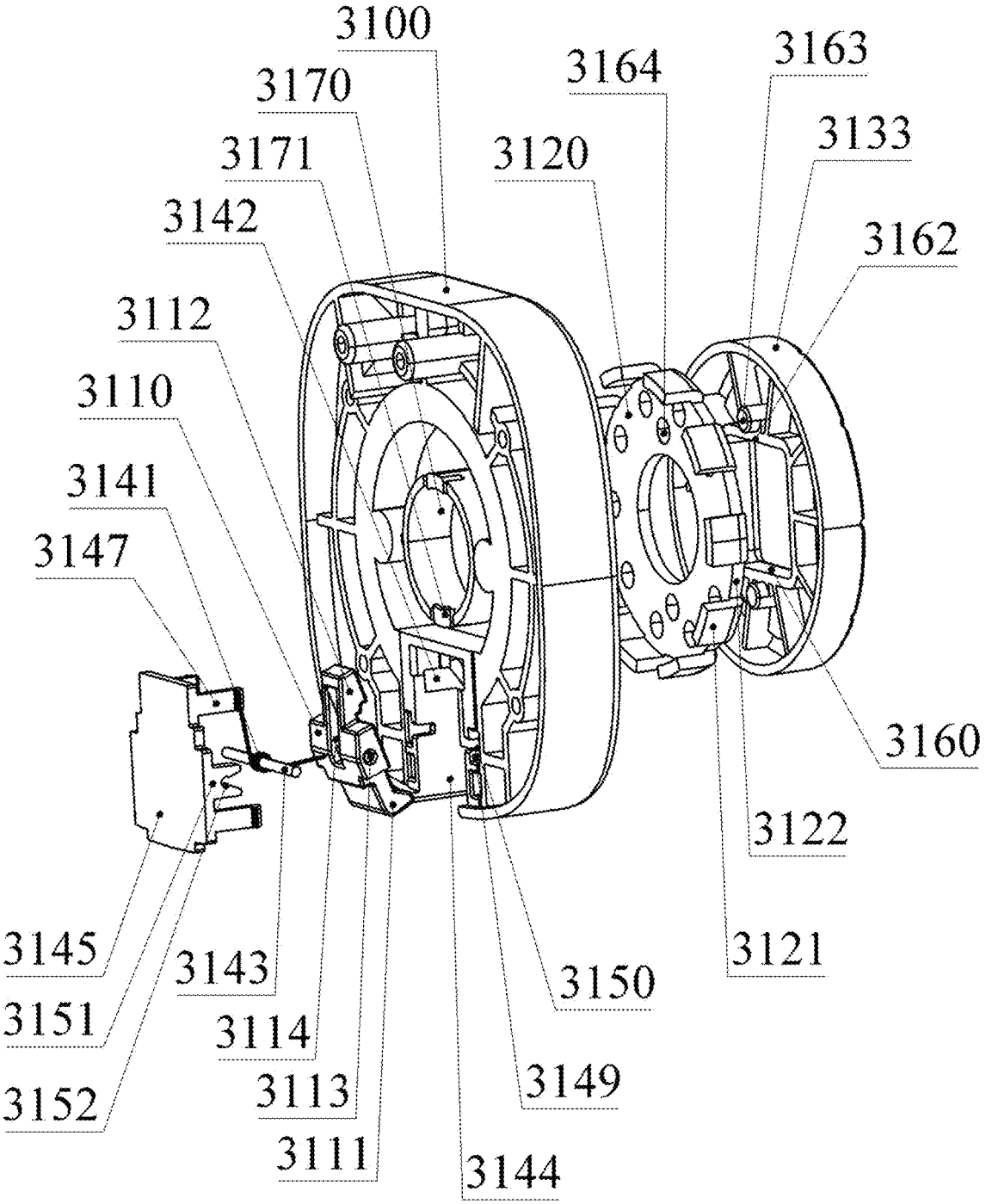
FIG. 8 is a partial schematic view of the locking structure.
Figure 9:
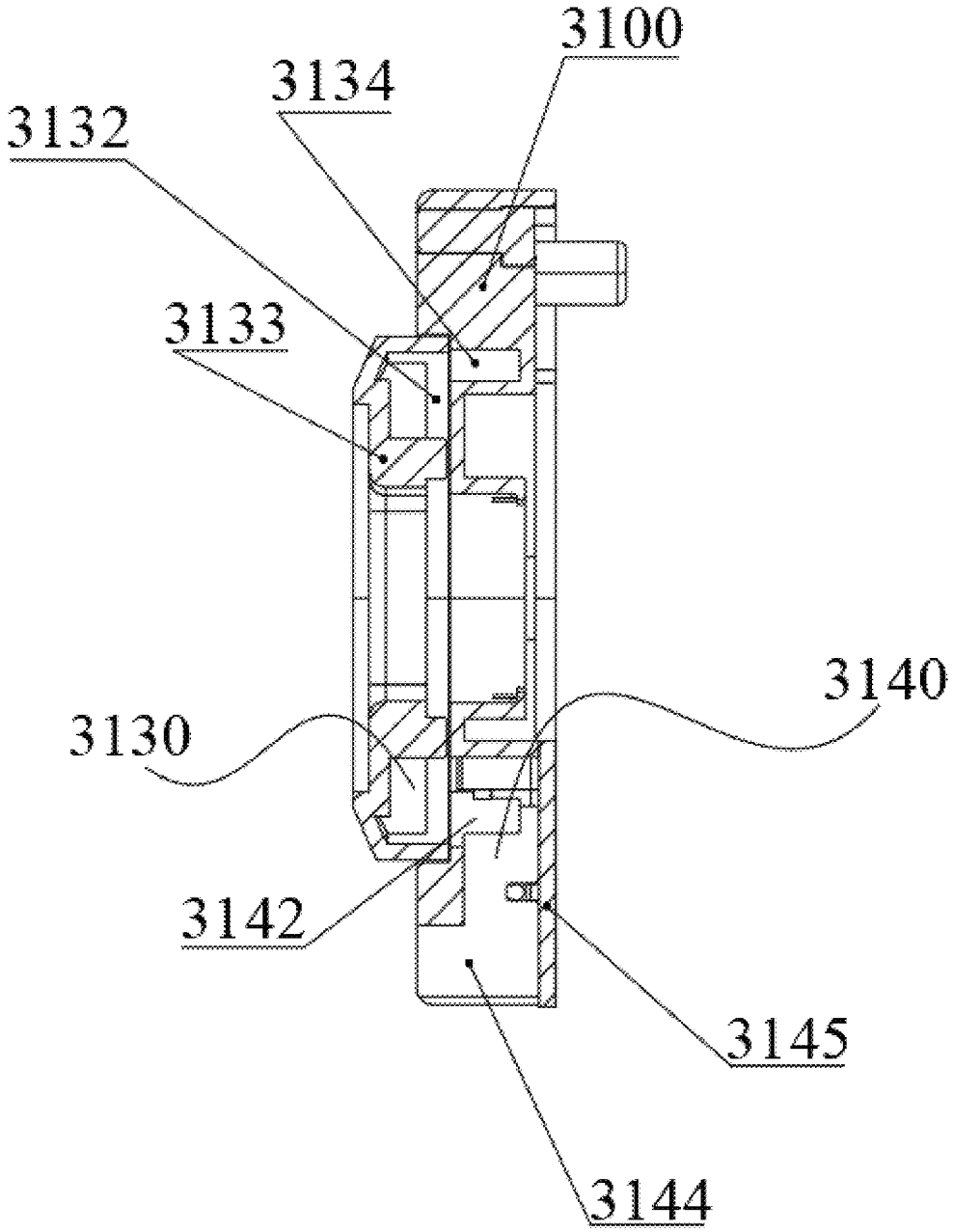
FIG. 9 is a partial sectional view of the locking part.

As shown in FIG. 8, the locking disk 3120 includes a plurality of locking protrusions 3121 and positioning groove 3122, and the locking member 3110 includes a locking hook 3111 and a locking block 3112, wherein at least part of the locking disk 3120 is located in the accommodating cavity 3140 through the first opening 3142, and the locking block 3112 elastically abuts against the locking protrusions 3121 or positioning groove 3122 through the elastic member 3141; the locking groove 3200 is used to receive the locking hook 3111 and lock the dumbbell body 1000.

As shown in FIGS. 2 and 9, in this embodiment, the base 2000 includes a weight plate groove 2100 for receiving the weight plates 1200 and a locking part groove 2200 for receiving the locking part 3100.

Specifically, the base is internally provided with a weight plate groove specially used for accommodating weight plates. This design not only makes the weight plates more orderly when stored, avoiding confusion and collision, but also ensures the stability of the weight plates during the use of dumbbells. The size and shape of the weight plate groove are accurately calculated to ensure that the weight plates with different weights can be closely attached, thus effectively preventing the weight plates from shaking or falling off during the movement. In addition, the base is also provided with a locking part groove, and the locking part groove is used for accommodating the locking part.

As shown in FIG. 2, FIG. 4 and FIG. 9, in this embodiment, the locking part groove 2200 is set to correspond to the shape of the locking part 3100, and a locking groove 3200 is formed in the locking part groove 2200. As shown in FIG. 5, the outer periphery of the locking groove 3200 is formed with an upper flange 2300 and a guide table 2400; the guide table 2400 is formed with a guide slope 2410; the end of the guide slope 2410 near the locking groove 3200 is lower than the end far away from the locking groove 3200, wherein the guide table 2400 is used to guide the locking hook 3111 into the locking groove 3200, and the upper flange 2300 is used to engage the locking hook 3111.

Specifically, the locking groove 3200 is arranged inside the locking part groove 2200, which provides an accurate insertion position for the locking hook 3111. The outer periphery of the locking groove 3200 is designed with an upper flange 2300 and a guide table 2400, which together constitute a stable support and guide mechanism of the locking hook 3111. The function of the upper flange 2300 is to clamp the locking hook 3111 to ensure that it is firmly fixed in the locking groove 3200 and prevent it from falling off due to unexpected circumstances.

The design of the guide table 2400 forms a guide slope 2410, which enables the locking hook 3111 to slide in smoothly along the slope when it is inserted into the locking groove 3200, and keeps the locking block 3112 away from the locking disk 3120. The end of the guide slope 2410 near the locking groove 3200 is designed to be lower, and the end far away from the locking groove 3200 is higher. This design not only conforms to the mechanical principle, but also conforms to the user's usage habits, which makes the insertion process of the locking hook 3111 more natural and smooth.

As shown in FIG. 5, when the dumbbell body is placed on the base, the locking hook 3111 in the locking member 3110 abuts against the guide slope 2410 and slides into the locking groove 3200. At this time, the locking block 3112 is far away from the locking disk 3120, and the locking disk 3120 is allowed to rotate freely.

When the locking block 3112 corresponds to the positioning groove 3122, the limiting disk 1320 in the plate selection mechanism 1300 locks the weight plates 1200. When the dumbbell body 1000 is lifted, the locking block 3112 is embedded in the positioning groove 3122, and the locking hook 3111 is disengaged from the locking groove 3200, that is, the dumbbell body and the base are unlocked.

As shown in FIG. 5, when the locking block 3112 corresponds to the locking protrusion 3121, the weight plate 1200 is separated from the limiting disk 1320. At this time, the locking protrusion 3121 abuts against the locking block 3112, and the locking hook 3111 cannot be separated from the locking groove 3200, that is, the dumbbell body and the base are locked.

In this embodiment, the plate selection mechanism 1300 enables the user to conveniently increase or decrease the weight plates 1200 according to the needs to adapt to different training needs. By turning the handle 1100, the weight plate 1200 can be locked or unlocked, and the operation is simple without using additional tools.

In this embodiment, the locking mechanism 3000 ensures the stability of the dumbbell during use. The locking part 3100 is matched with the locking groove 3200 of the base 2000, which ensures the stable locking of the dumbbell body on the base 2000, prevents the dumbbell from accidentally falling off or loosening during training, and improves the use safety.

In this embodiment, because the dumbbell body 1000 includes a plurality of weight plates 1200, and the weight plates 1200 can be increased or decreased by the plate selection mechanism 1300, the dumbbell can be adjusted individually according to the body shape, strength level and training objectives of different users, and has high adaptability.

In other embodiments (not shown in the figure), sensors and smart chips are provided to realize real-time monitoring and recording of dumbbell usage data, such as weight, usage time and training times. These data can be transmitted to mobile phones or computers via Bluetooth or Wi-Fi, which helps users to make training plans more scientifically.

In other embodiments (not shown in the figure), the weight plates 1200 can adopt different colors or materials to meet the aesthetic needs of different users. At the same time, you can also engrave logos or patterns on the weight plates 1200 to increase the personalized characteristics of dumbbells.

In other embodiments (not shown in the figure), the surface of the handle 1100 can be made of anti-slip material or designed with anti-slip texture, so as to improve the user's grip stability when using dumbbells and reduce accidents caused by hand sliding.

In other embodiments (not shown in the figure), dumbbells can be combined with other fitness equipment or accessories in addition to the basic weight lifting function to realize more diverse training methods. For example, a connecting member can be added to the dumbbell, so that it can be used in conjunction with equipment such as a stretcher and a barbell.

Figure 7:
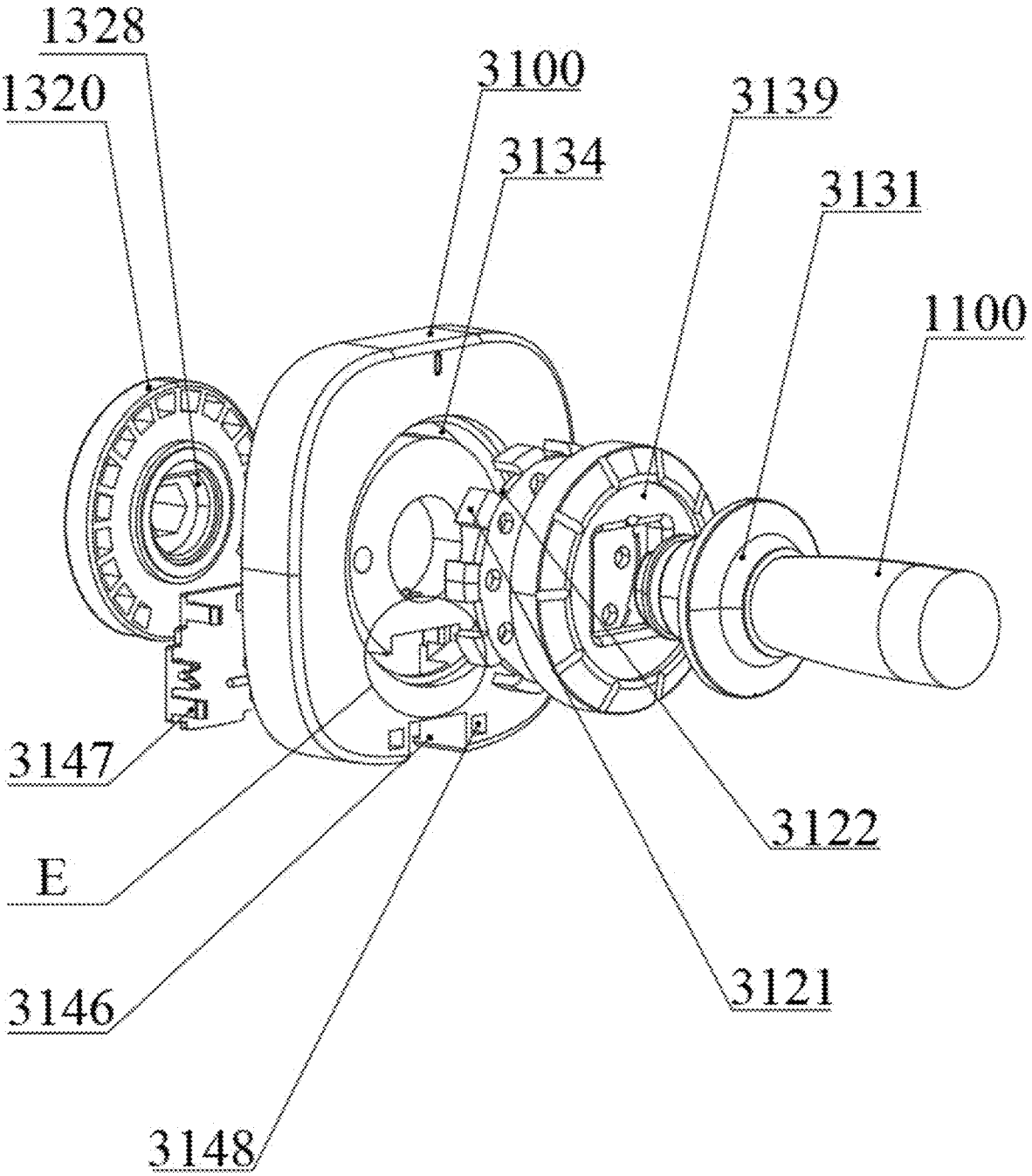
FIG. 7 is another schematic view of FIG. 6.

As shown in FIG. 9, in this embodiment, the accommodating cavity 3140 includes an accommodating groove 3144 and an accommodating cover 3145, wherein the accommodating groove 3144 is arranged in the locking part 3100 (see FIG. 8), the accommodating cover 3145 is arranged to correspond to the shape of the accommodating groove 3144 and attached to the accommodating groove 3144 to form the accommodating cavity 3140. As shown in FIG. 7, a first opening 3142 and a second opening 3146 are formed in the accommodating groove 3144; the first opening 3142 is a channel for the locking member 3110 and the locking disk 3120 to contact, and the second opening 3146 is a channel for the locking member 3110 and the locking groove 3200 to contact.

Specifically, the accommodating cavity 3140 consists of an accommodating groove 3144 and an accommodating cover 3145. The accommodating groove 3144 is arranged in the locking part 3100, and its shape and size are accurately calculated to ensure that key components such as the locking part 3110 and the elastic part 3141 can be accommodated. The accommodating cover 3145 is designed to match the shape of the accommodating groove 3144. By attaching the accommodating groove 3144, the two together form a closed and stable accommodating cavity 3140, which not only improves the overall structural strength of the dumbbell, but also ensures the stability and reliability of the locking mechanism 3000 during use.

As shown in FIG. 7, first opening and a second opening 3142 are formed in the accommodating groove 3144. The first opening serves as a contact channel between the locking member and the locking disk, and its position and size are precisely adjusted to ensure that the locking member can contact and interact with the locking disk smoothly. The second opening serves as a contact channel between the locking member and the locking groove, and its design also takes into account the convenience of operation and the stability of the structure.

As shown in FIG. 7, in this embodiment, at least one buckling protrusion 3147 is formed on the accommodating cover 3145, and at least one buckling groove 3148 is formed in the accommodating groove 3144, which corresponds to the buckling protrusion 3147, and the accommodating cover 3145 and the locking part 3100 are detachably connected through the buckling protrusion 3147 and the buckling groove 3148.

Specifically, the edge of the accommodating cover is designed with at least one buckling protrusion, which presents a delicate protruding structure. After precise calculation and mechanical test, it is ensured to have sufficient stability and strength when connecting. At the same time, at the corresponding position of the accommodating groove, at least one buckling groove is provided, and the shapes and sizes of these buckling grooves match with the buckling protrusions to ensure that they can be accurately butted.

In the assembly process, the user only needs to align the accommodating cover with the accommodating groove, and gently press it, so that the buckling protrusion will smoothly slide into the buckling groove, forming a tight and stable connection. This connection mode is not only simple and convenient, but also ensures the tightness and structural integrity of the accommodation cavity. At the same time, due to the detachable design, when it is necessary to clean or maintain the internal components of the accommodation cavity, the user can easily remove the accommodation cover, which is convenient for operation.

The user can easily disassemble and assemble the accommodating cover through the detachable connection mode of the buckling protrusion and the buckling groove. This design not only simplifies the operation process and improves the use efficiency, but also facilitates the maintenance and cleaning of dumbbells by users. The tight combination of the buckling protrusion and the buckling groove makes a stable connection between the accommodating cover and the accommodating groove. This design effectively prevents the accommodation cover from loosening or falling off during use, thus enhancing the stability of the whole dumbbell structure. The detachable design enables the user to conveniently remove the accommodating cover for operation when the internal components of the accommodating cavity need to be replaced or repaired. This not only reduces the maintenance cost, but also improves the service life of dumbbells.

In this embodiment, the accommodating cover and the locking part are detachably connected through the locking protrusion and the locking groove. In other embodiments (not shown in the figure), the receiving cover and the locking part are not limited to being connected by snap connection, but can also be arranged as screw connection, screw connection, rivet connection, pin connection, welding and any desired connection mode.

As shown in FIGS. 5 to 7, in this embodiment, at least one embedding groove 3149 is formed in the accommodating groove 3144, and a first shaft clamping groove 3150 is formed on one side of the embedding groove 3149, and the first shaft clamping groove 3150 is set to correspond to the shape of the second rotating shaft 3143; at least one embedded protrusion 3151 is formed in the accommodating cover 3145, and the embedded protrusion 3151 is set to correspond to the shape of the embedding groove 3149; a second shaft clamping groove 3152 is formed on the embedded protrusion 3151, and the second shaft clamping groove 3152 corresponds to the first shaft clamping groove 3150, wherein the second rotating shaft 3143 is arranged in the first shaft clamping groove 3150 and the second shaft clamping groove 3152.

Specifically, at least one embedding groove is designed inside the accommodating groove, and the shapes and sizes of these embedding grooves are accurately calculated to match the embedded protrusions on the accommodating cover. On one side of the embedding groove, a first shaft clamping groove is opened, the shape of which is matched with that of the second rotating shaft, so as to ensure that the second rotating shaft can be firmly placed therein.

Correspondingly, the edge of the accommodating cover is designed with embedded protrusions, which are consistent with the shape of the embedding groove. When the accommodating cover is butted with the accommodating groove, the embedded protrusions can be accurately embedded into the embedding groove to form a tight fit. At the same time, in the corresponding position of the embedded protrusion, a second shaft clamping grooves are designed, which are aligned with the first shaft clamping grooves and jointly provide a stable support for the second rotating shaft.

Among them, the second rotating shaft can be firmly fixed in the first shaft clamping groove and the second shaft clamping groove, which not only ensures its rotating flexibility, but also enhances its structural stability. This structure not only improves the overall strength of the dumbbell, but also makes the dumbbell safer and more reliable in use.

The locking mechanism of the dumbbell is more stable in structure through the matching of the embedding groove and the embedded protrusion, and the fixing of the first clamping shaft groove and the second clamping shaft groove to the second rotating shaft. This design effectively reduces the risk of failure caused by loose or misplaced parts, and improves the durability and service life of dumbbells. Moreover, the butting design of the embedding groove and the embedded protrusion makes the assembly process of the accommodating cover and the accommodating groove simpler and faster. Users can easily complete the assembly without complicated operation, which improves the use efficiency.

When the interior of the accommodating cavity needs to be cleaned or maintained, the user can conveniently disassemble the accommodating cover without worrying about damaging the whole structure. This design makes the maintenance process of dumbbells easier and more convenient.

This embodiment not only enhances the structural stability and operation convenience of the dumbbell, but also improves its maintenance convenience and safety by optimizing the connection structure between the accommodating groove and the accommodating cover and the fixing mode of the second rotating shaft. These improvements make dumbbells not only meet the basic fitness needs of users, but also provide a more reliable and safe use experience.

As shown in FIGS. 5 to 7, in this embodiment, at least one rotating shaft hole 3113 and an elastic groove 3114 are provided in the locking member 3110, and the rotating shaft hole 3113 is communicated with the elastic groove 3114, and the second rotating shaft 3143 penetrates through the rotating shaft hole 3113, and the elastic member 3141 is sleeved on the second rotating shaft, wherein the elastic member 3141 is located in the elastic groove 3114.

In this embodiment, the elastic member is arranged as a torsion spring, one end of the torsion spring pushes against the elastic groove, and the other end of the torsion spring abuts against the accommodating cover. In other embodiments (not shown in the figure), the elastic member is not limited to being a torsion spring, but can also be a leaf spring, a spiral spring, a torsion bar spring, a gas spring, a rubber spring, and any elastic member as desired.

As shown in FIGS. 6 to 8, in this embodiment, the rotating cavity 3130 includes a rotating groove 3132 and a rotating cover 3133. The rotating groove 3132 is arranged in the locking part 3100, and the rotating cover 3133 is arranged to correspond to the shape of the rotating groove 3132 and attached to form the rotating cavity 3130. An inscribed groove 3134 is formed in the rotating groove 3132, and the inscribed groove 3134 communicates with the first opening 3142, wherein a plurality of locking protrusions 3121 and positioning groove 3122 are disposed in the inscribed groove 3134.

Specifically, the rotating groove is skillfully arranged in the locking part, and its shape is precisely designed to ensure the perfect fit with the rotating cover. The rotating cover is made according to the shape of the rotating groove and can be closely attached to the rotating groove, thus forming a closed and stable rotating cavity, effectively preventing the invasion of external impurities or moisture, and ensuring the normal operation and structural stability of the rotating shaft.

In this embodiment, an inscribed groove is specially opened inside the rotating groove, and the inscribed groove is communicated with the first opening, which provides a space for the locking protrusion and the clamping groove to abut against the locking block. A plurality of locking protrusions and positioning grooves are carefully arranged in the inscribed groove, and their positions and shapes are accurately calculated to ensure accurate interaction with the locking disk or clamping groove during rotation.

As shown in FIGS. 2 and 5, in this embodiment, first rotating shafts 3131 are provided at both ends of the handle 1100, and each of the first rotating shafts 3131 includes a rim part 3135, a first driving part 3136, a rotating part 3137, and a second driving part 3138 in order from near to far from the handle 1100. As shown in FIG. 3, first rotating shafts 3131 includes two first rotating shafts, namely, a first first rotating shaft 3131 and a second first rotating shaft 3131, each configured in the same manner.

Specifically, two ends of the handle are respectively provided with a first rotating shaft, and the design of this rotating shaft not only considers the stability of the structure, but also takes into account the convenience of operation. From the proximal end to the distal end of the handle, the first rotating shaft consists of a rim part, a first driving part, a rotating part and a second driving part in turn. This segmented design enables each part to give full play to its unique function, and at the same time, it can work together with other parts to realize the overall function of the dumbbell.

Wherein, the rim part is the connection part between the rotating shaft and the handle, and its design fully considers the stability of the structure and the firmness of the connection, ensuring that the rotating shaft can remain stable when it is acted by external force and is not easy to loosen or fall off. The first driving part mainly undertakes the function of driving the locking disk to rotate. When the user needs to adjust the weight of the dumbbell, he can drive the locking disk to rotate by operating the first driving part, so as to drive the locking member to move and realize the locking or releasing of the dumbbell.

As shown in FIGS. 5 to 7, in this embodiment, a rim groove 3139 is formed at one end of the rotating cover 3133 far away from the locking disk 3120, and the rim groove 3139 is formed in a shape corresponding to the rim part 3135; the rim part 3135 is disposed in the rim groove 3139, and a first driving groove 3160 is formed in the rim groove 3139; and the first driving groove 3160 is set in a shape corresponding to the first driving part 3136, and the first driving part 3136 is set in the first driving groove 3160.

In this embodiment, a first limiting protrusion 3161 is formed on the first driving part 3136, and a first limiting groove 3162 is formed in the first driving groove 3160; the first limiting protrusion 3161 is arranged in the first limiting groove 3162, wherein when the handle 1100 is rotated, the rotating cover 3133 and the first rotating shaft 3131 rotate synchronously through the first driving groove 3160, the first driving part 3136, the first limiting protrusion 3161 and the first limiting groove 3162.

In this embodiment, the locking mechanism of the dumbbell further realizes the precise fit and synchronous rotation between the rotating cover and the first rotating shaft. This design not only improves the operation fluency of the dumbbell, but also ensures the stability and reliability of the structure.

Specifically, at the end of the rotating cover far away from the locking disk, the rim groove is carefully designed. The shape of this groove position completely corresponds to the rim part on the first rotating shaft, so that the rim part can be accurately arranged in the rim groove. This design ensures the close connection between the rotating cover and the first rotating shaft, and prevents the loosening or dislocation during use.

In order to further improve the synchronization and stability of rotation, the first driving groove is specially set in the rim groove. The shape of this groove is consistent with the first driving part on the first rotating shaft, so that the first driving part can be accurately arranged in the first driving groove. When the user rotates the handle, the first driving part will rotate under the guidance of the first driving groove, thus driving the whole rotating cover to rotate.

In order to further enhance the stability and reliability of rotation, a first limiting protrusion is also formed on the first driving part, and a first limiting groove is correspondingly arranged in the first driving groove. The first limiting protrusion can be accurately arranged in the first limiting groove, which effectively prevents the deviation or shaking during the rotation and ensures the stability and accuracy of the rotation.

As shown in FIGS. 5 to 7, in this embodiment, a linkage block 3163 is provided at one end of the rotating cover 3133 close to the locking disk 3120, and a linkage hole 3164 is provided on the locking disk 3120, and the linkage block 3163 is arranged in the linkage hole 3164, wherein when the rotating cover 3133 rotates, the rotating cover 3133 and the locking disk 3120 pass through the linkage block 3163 and the linkage hole 3164.

In this embodiment, the locking mechanism of dumbbell realizes the synchronous rotation between the rotating cover and the locking disk through the design of the linkage block and the linkage hole. This structure not only enhances the overall stability of the dumbbell, but also improves the convenience of operation.

Specifically, a linkage block is specially designed at one end of the rotating cover close to the locking disk. This linkage block is made of high-quality materials, with sufficient strength and wear resistance to ensure that it can still maintain a good working condition during long-term use.

At the same time, the locking disk is correspondingly provided with a linkage hole. The shape and size of the linkage hole are matched with the linkage block, so that the linkage block can be accurately inserted into it and closely matched with the locking disk.

When the user turns the handle, the rotating cover rotates with it. Due to the cooperation between the linkage block and the linkage hole, the rotation of the rotating cover will drive the locking disk to rotate synchronously. This synchronous rotation design ensures the stability and consistency of dumbbells during weight adjustment.

Through the design of the linkage block and the linkage hole, the user can realize the synchronous rotation of the rotating cover and the locking disk without additional operation when rotating the handle. This design simplifies the operation steps, improves the convenience of operation, and enables users to complete the weight adjustment of dumbbells more quickly and accurately. The close cooperation between the linkage block and the linkage hole effectively prevents looseness or dislocation during rotation. This stability not only ensures the reliability of dumbbells in use, but also improves the durability of dumbbells and prolongs their service life. Because the rotating cover and the locking disk can rotate synchronously, the dumbbell can maintain a stable structural state in the process of weight adjustment. This helps to reduce accidents caused by improper operation or loose structure, and improves the safety of users during exercise.

As shown in FIGS. 5 to 7, in this embodiment, the locking part 3100 is provided with a rotating hole 3170, which is in a shape corresponding to the rotating part 3137. The rotating part 3137 is arranged in the rotating hole 3170, and the rotating hole 3170 extends inward to form a clamping protrusion 3171, and a clamping groove 3165 is formed on the rotating part 3137, the clamping groove 3165 is set in a shape corresponding to the clamping protrusion 3171, and the locking part 3100 and the first rotating shaft 3131 are rotatably connected through the clamping protrusion 3171 and the clamping groove 3165.

In this embodiment, the locking mechanism of dumbbell is further optimized in structural details, especially the connection mode between the locking part and the first rotating shaft. This design not only enhances the structural stability, but also improves the fluency and accuracy of operation.

Specifically, a rotating hole is specially opened in the locking part. The shape of this rotating hole completely corresponds to the rotating part on the first rotating shaft, so that the rotating part can be accurately arranged in the rotating hole. This design ensures the stability of the rotating part in the process of rotation and reduces the structural looseness caused by shaking or deviation.

Further, the rotating hole not only provides a space for the rotating part, but also extends inward to form a locking protrusion. The clamping protrusion is matched with the clamping groove on the rotating part, forming the key part of the rotating connection. When the rotating part is arranged in the rotating hole, the clamping protrusion will be accurately embedded into the clamping groove, thus realizing the stable connection between the locking part and the first rotating shaft.

The design of the clamping protrusion and the clamping groove not only strengthens the stability of the connection, but also improves the smoothness of rotation. When the user operates the dumbbell, he can feel the smooth rotation of the rotating part in the rotating hole, and the existence of the clamping protrusion and the clamping groove ensures the accuracy and stability of the rotation.

Figure 10:
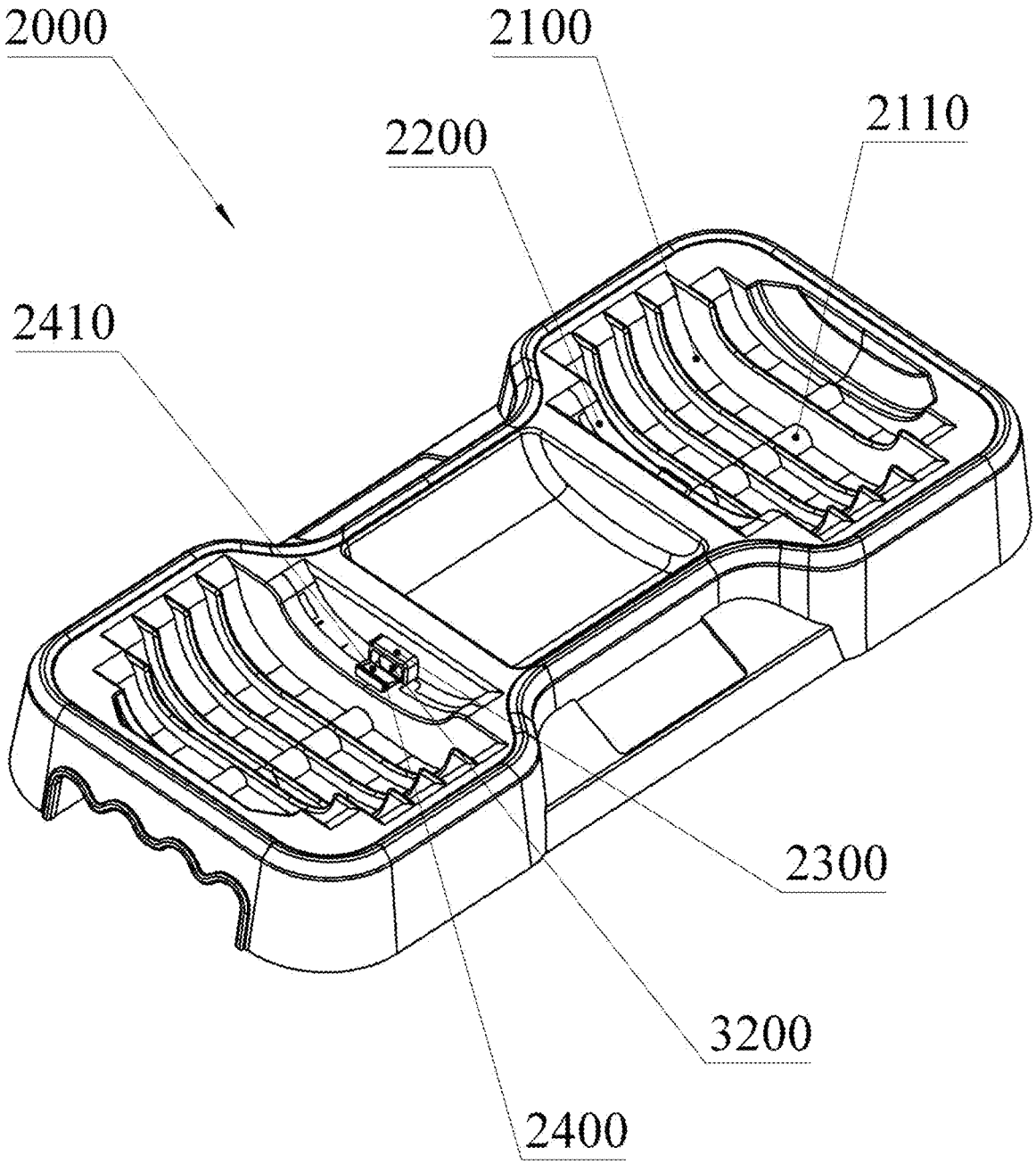
FIG. 10 is a schematic view of the base.
Figure 11:
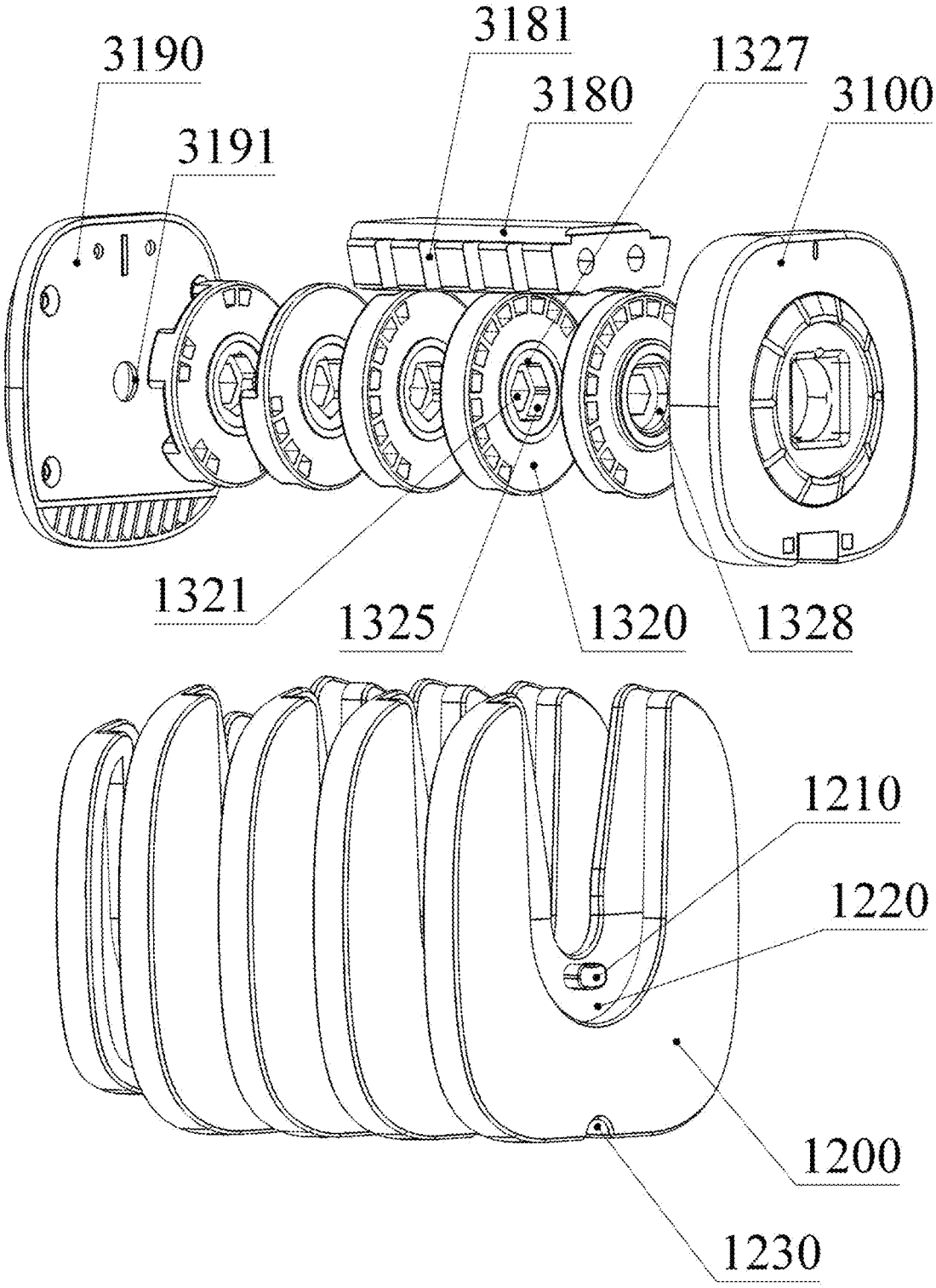
FIG. 11 is a partial explosion of dumbbell.

As shown in FIG. 3, FIG. 10 and FIG. 11, in this embodiment, a plate selection mechanism 1300 is provided on the handle 1100. The plate selection mechanism 1300 includes a driving rod 1310, a plurality of limiting disk 1320, and is configured to connect to weight plates 1200. The driving rod 1310 penetrates through the handle 1100 and is fixedly connected with the first rotating shaft 3131, and the limiting disk 1320 are provided on the driving rod 1310.

In this embodiment, a plate selection mechanism is added to the handle of the dumbbell, which not only enriches the functionality of the dumbbell, but also greatly improves the user experience. The plate selection mechanism is mainly composed of a driving rod, a plurality of limiting disks and weight plates. These parts work together to make the weight adjustment of dumbbells more convenient and accurate.

Specifically, the driving rod is skillfully inserted in the handle and the first rotating shaft, and the fixed connection is realized. This design ensures that the driving rod can drive the first rotating shaft and the locking mechanism connected with it to move synchronously when rotating. At the same time, the position and length of the driving rod are accurately calculated to ensure that it can smoothly pass through the handle and the first rotating shaft without any interference or obstruction.

As shown in FIG. 11, in this embodiment, a driving hole 1321 is provided in the limiting disk 1320, and the driving hole 1321 is in a shape corresponding to the driving rod 1310, and the driving rod 1310 is provided in the driving hole 1321.

In this embodiment, at least one first plate selection bump 1322 and a first plate selection groove 1323 are arranged in the limiting disk 1320, and at least one second plate selection bump 1210 and a second plate selection groove 1220 are arranged on the weight plate 1200. The second plate selection bump 1210 is set in a shape corresponding to the shape of the first plate selection groove 1323, and the second plate selection groove 1220 is set in a shape corresponding to the first plate selection bump 1223; and the weights of the weight plates 1200 are different, and the sizes of the first plate selection bump 1322 and the first plate selection groove 1323 in the limiting disk 1320 are also different;

wherein, when the weight plate 1200 is locked by the plate selection mechanism 1300, the first plate selection bump 1322 is disposed in the second plate selection groove 1220, and the second plate selection bump 1210 is disposed in the first plate selection groove 1323.

In this embodiment, the design of the dumbbell's plate selection mechanism has been further optimized, especially in the way of cooperation between the limiting disk, the driving rod and the weight plate. This design not only enhances the accuracy of dumbbell selection, but also improves the convenience and stability of its operation.

Wherein, a driving hole is arranged in the limiting disk. The shape of this driving hole completely corresponds to the driving rod, so that the driving rod can be accurately arranged in the driving hole. This design ensures that the driving rod can drive the limiting disk to rotate synchronously when rotating, thus realizing the accurate selection of the weight plate.

In addition, in each limiting disk, at least one first plate selection bump and a first plate selection groove are arranged. The shapes and sizes of these bumps and grooves are carefully designed to ensure that they can be accurately matched with the second plate selection bump and the second plate selection groove on the weight plate. It is worth noting that the weight plates with different weights correspond to the first plate selection bump and the first plate selection groove with different sizes. This design enables each limiting disk to match the weight plate with a specific weight, thus realizing the accurate control of the weight of the weight plate.

In the design of weight plates, each weight plate is provided with at least one second plate selection bump and a second plate selection groove, and their shapes correspond to the first plate selection bump and the first plate selection groove on the limiting disk respectively. This design enables the weight plate to be closely matched with the limiting disk. When the weight plate is locked by the plate selection mechanism, the first plate selection bump will be accurately arranged in the second plate selection groove, and the second plate selection bump will also be arranged in the first plate selection groove. This double locking mechanism ensures the stability of the weight plate during use, and further prevents the potential safety hazard caused by accidental falling off.

By optimizing the matching mode between the limiting disk, the driving rod and the weight plate, this embodiment realizes the accurate control of the weight of the weight plate. Each limiting disk can be matched with the weight plate with a specific weight, thus avoiding the weight deviation caused by wrong selection or wrong selection. The user can quickly select and lock the weight plate only by rotating the driving rod. Due to the precise cooperation between the limiting disk and the weight plate, the user can easily adjust the weight of the dumbbell without complicated operation or adjustment. The double locking mechanism ensures the stability of the weight plate during use. Even in high-intensity exercise, the weight plate can remain firmly locked, preventing accidents caused by falling off or shaking.

To sum up, this embodiment improves the accuracy of dumbbell selection, convenience of operation and structural stability by optimizing the design of the plate selection mechanism, and provides users with a safer and more efficient fitness experience.

Figure 12:
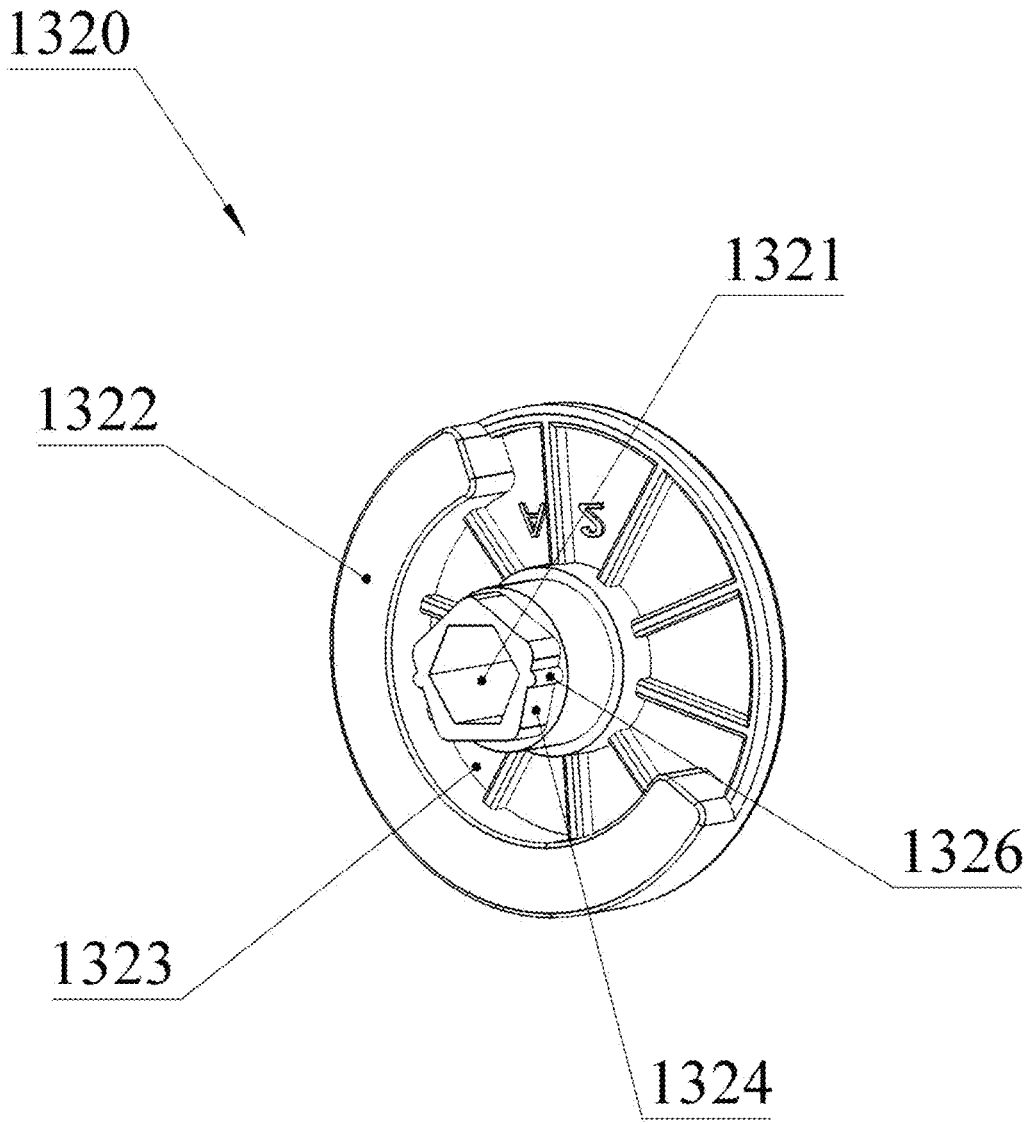
FIG. 12 is a schematic diagram of the limiting disk.
Figure 13:
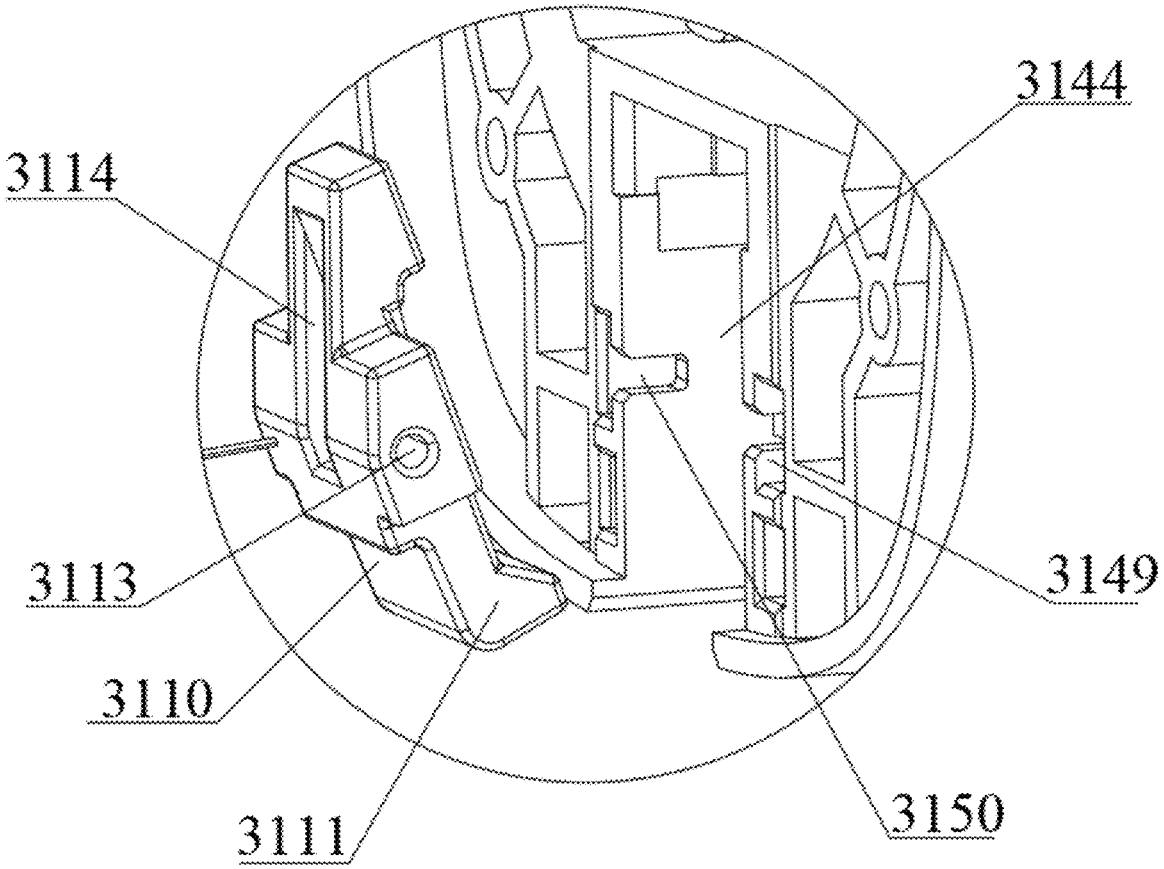
FIG. 13 is an enlarged view of point B in FIG. 6.
Figure 14:
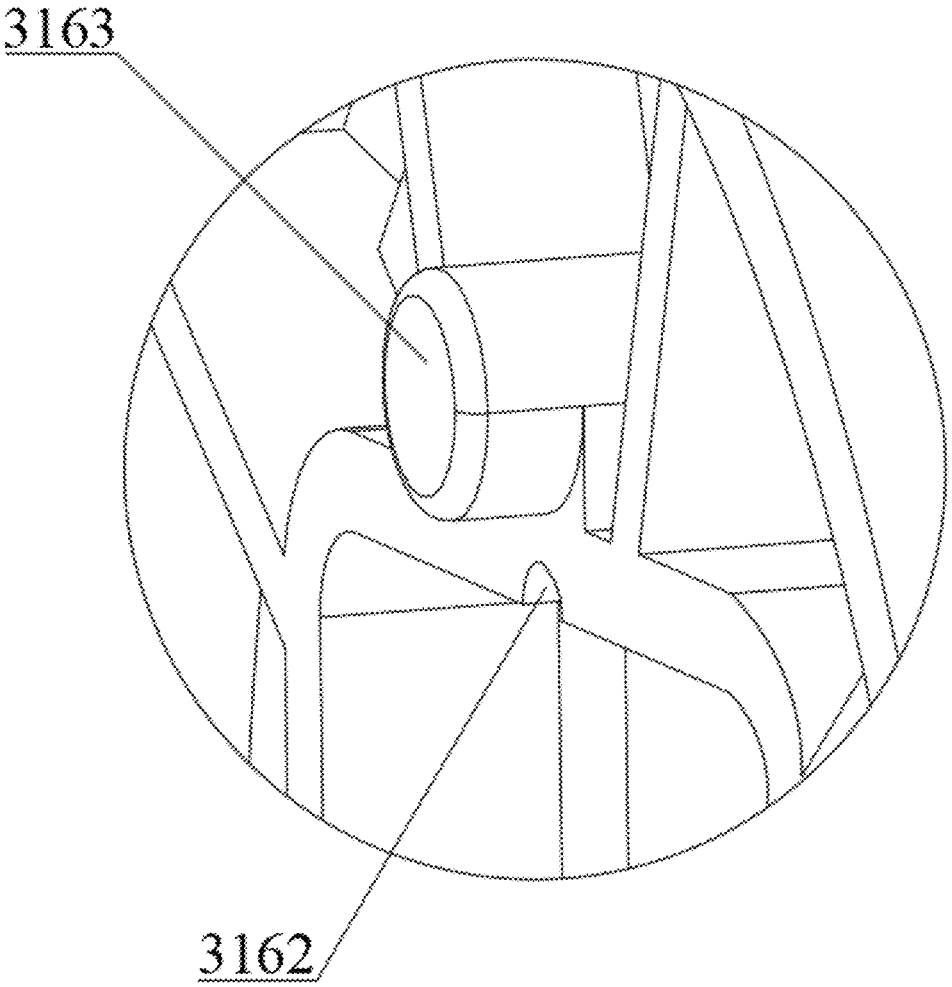
FIG. 14 is an enlarged view of point C in FIG. 6.
Figure 15:
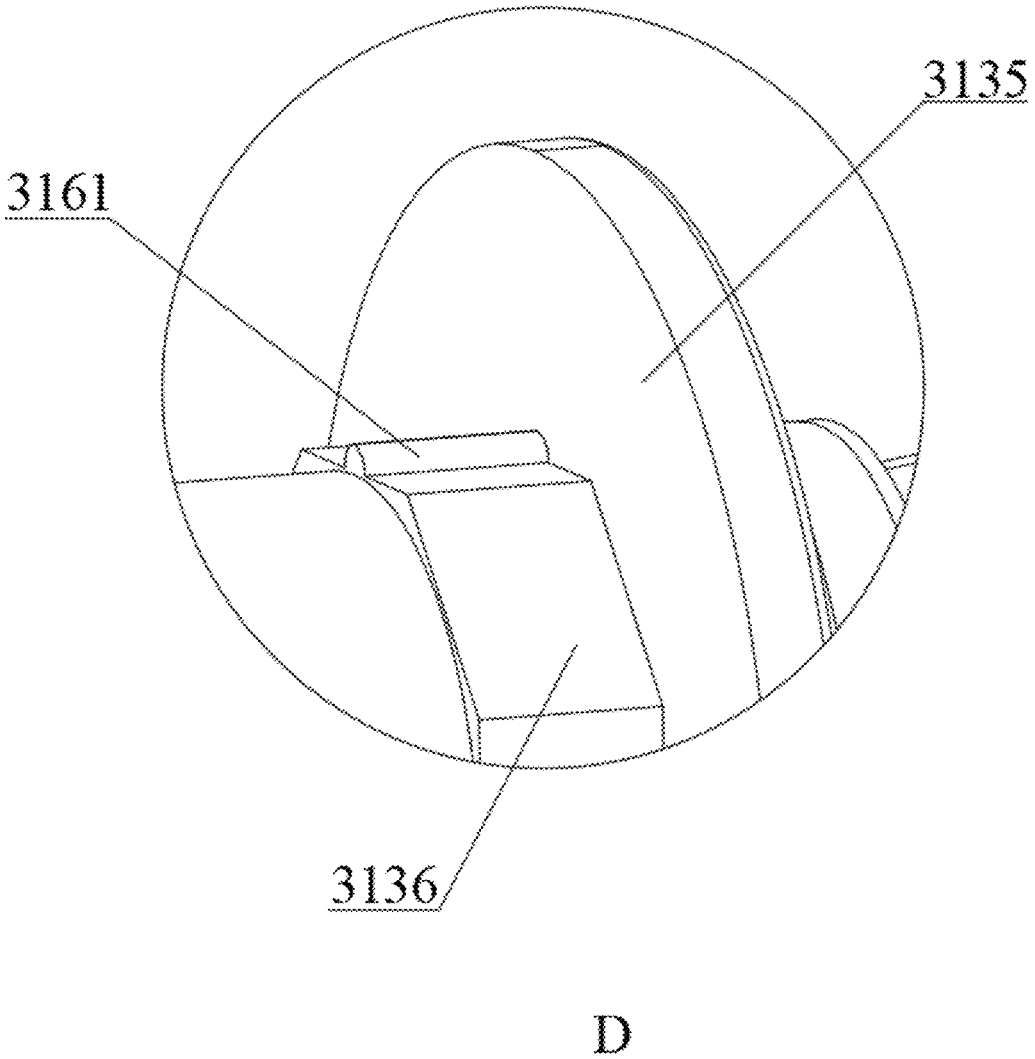
FIG. 15 is an enlarged view of point D in FIG. 6.
Figure 16:
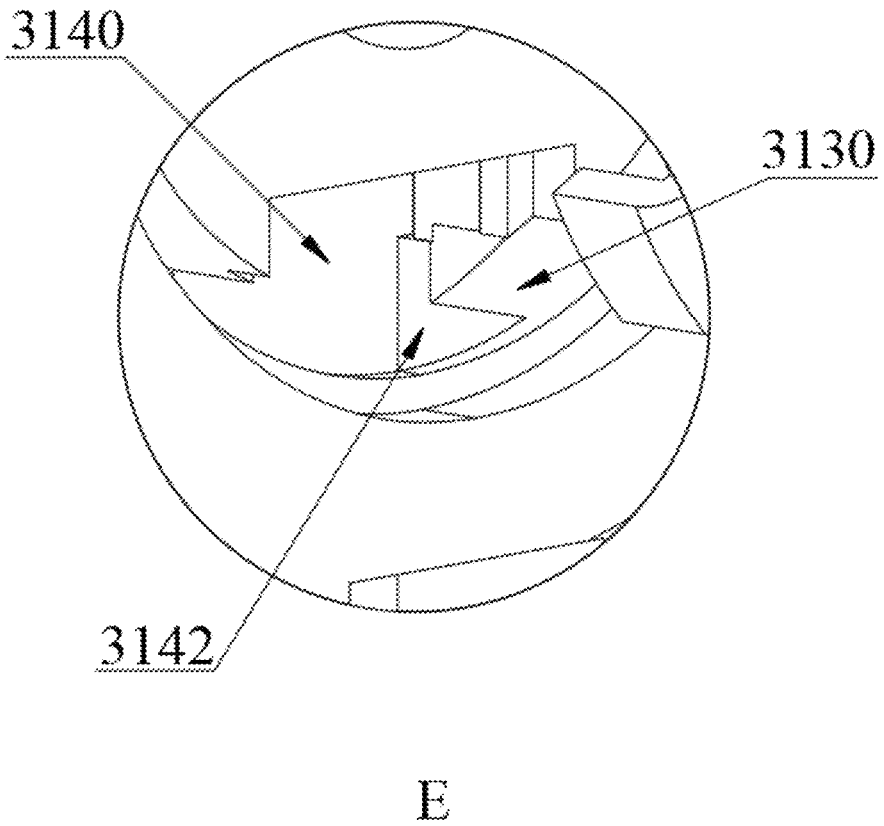
FIG. 16 is an enlarged view of point E in FIG. 7.

As shown in FIGS. 11 and 12, in this embodiment, the limiting disk 1320 is provided with a connecting part 1324 and a connecting groove 1325 for receiving the connecting part 1324; a second limiting protrusion 1326 is provided on the connecting part 1324, and a second limiting groove 1327 is provided in the connecting groove 1325, and the second limiting groove 1327 is arranged in a shape corresponding to the second limiting protrusion 1326. The second limiting protrusion 1326 is disposed in the second limiting groove 1327, and a plurality of limiting disk 1320 rotate synchronously through the connecting part 1324, the connecting groove 1325, the second limiting protrusion 1326 and the second limiting groove 1327.

In this embodiment, the dumbbell selection mechanism further enhances its structural stability and convenience of operation, which is mainly due to the unique connection mode between the limiting disks. Through the carefully designed connecting parts and grooves, and the corresponding second limiting protrusions and grooves, a plurality of limiting disks realize synchronous rotation, thus ensuring the stability and consistency of the dumbbell in the weight adjustment process.

Specifically, each limiting disk is provided with a connecting part and a connecting groove. The connecting part is usually designed as a protrusion, and the connecting groove is correspondingly designed as a depression to receive the connecting part. This design enables the adjacent limiting disks to be closely connected together through the mutual nesting of the connecting part and the connecting groove.

In order to further enhance the connection stability between the limiting disks, the connection part is specially provided with a second limiting protrusion. These protrusions have a specific shape and size, and can be accurately matched with the second limiting groove in the connecting groove. The shape of the second limiting groove is designed to completely correspond to the second limiting protrusion, so as to ensure that the second limiting protrusion can be accurately arranged in the second limiting groove.

When a plurality of limiting disks are connected with each other through the connecting part, the connecting groove, the second limiting protrusion and the second limiting groove, they can realize synchronous rotation. This synchronous rotation design not only simplifies the operation steps, but also improves the consistency and stability of dumbbells in the process of weight adjustment. When the user rotates the handle, the driving rod will drive one limiting disk to rotate, and other limiting disks will rotate synchronously due to the tight connection and synchronous rotation mechanism between the limiting disks, thus realizing accurate selection and locking of weight plates with different weights.

As shown in FIG. 3, in this embodiment, one end of the limiting disk 1320 closest to the handle 1100 near the handle 1100 is provided with a second driving groove 1328, which is arranged in a shape corresponding to the second driving part 3138, wherein, the second driving part 3138 is disposed in the second driving groove 1328.

In this embodiment, in the connection mode between the limiting disk closest to the handle and the driving mechanism. By adding the second driving groove and the second driving part, the close cooperation and efficient driving between the handle and the limiting disk are realized, thus improving the convenience of operation and the safety of use of the dumbbell.

Specifically, a second driving groove is specially arranged at the end of the limiting disk closest to the handle near the handle. The shape and size of this driving groove are precisely designed to ensure that it can completely correspond to the second driving part. As a part of the driving mechanism, the second driving part is matched with the second driving groove in shape and size, and can be accurately arranged in the second driving groove.

When the user rotates the driving rod through the handle, the first driving part on the driving rod first starts to work to drive the limiting disk connected with it to rotate. Subsequently, due to the close cooperation between the second driving groove on the limiting disk closest to the handle and the second driving part, the second driving part can act by following the rotation of the driving rod, further driving the limiting disk and its subsequent connected limiting disk to rotate synchronously. This dual driving mechanism ensures the stability and consistency of dumbbells in the plate selection process.

In addition, through the arrangement of the second driving groove and the second driving part, the dumbbell plate selection mechanism is more compact and reasonable in structure. This design not only reduces unnecessary parts and connections, but also improves the stability and reliability of the whole structure. At the same time, due to the direct connection between the driving mechanism and the limiting disk, the loss in the process of energy transmission is reduced, which makes the dumbbell rotate more smoothly and efficiently.

As shown in FIG. 9, in this embodiment, an engaging strip 2110 is arranged in the weight plate groove 2100, and an engaging groove 1230 is arranged on the weight plate 1200, and the engaging groove 1230 is arranged in a shape corresponding to the engaging strip 2110, wherein the engaging strip 2110 is located in the engaging groove 1230 when the weight plate 1200 is arranged in the weight plate groove 2100.

Through the close cooperation between the engaging strip and the engaging groove, the connection between the weight plate and the dumbbell base becomes more stable. This improvement of stability not only reduces the possibility of the weight plate shaking during use, but also avoids the potential safety hazard caused by the weight plate falling off, ensuring the safety and comfort of users' exercise.

As shown in FIG. 2, in this embodiment, a limiting part 3180 is arranged at one end of the locking part 3100 near the dumbbell, one end of the limiting part 3180 is fixedly connected with the locking part 3100, and the other end of the limiting part 3180 is fixedly connected with a tail disk 3190, and a through hole 3191 is arranged on the tail disk 3190, and the through hole 3191 is shaped to accommodate the driving rod 1310; the driving rod 13 is rotatably disposed in the through hole 3191, wherein the weight plate 1200 is disposed between the locking part 3100 and the tail disk 3190.

Specifically, a limiting part is added at one end of the locking part near the dumbbell, and one end of the limiting part is fixedly connected with the locking part, thus ensuring the stability of the structure; the other end is connected with the tail disk, forming a complete structural unit. The design of the through hole on the tail disk is particularly critical, which can not only accommodate the driving rod, but also allow the driving rod to rotate therein. This design enables the driving rod to flexibly drive the plate selection mechanism to lock or unlock, thus realizing the quick replacement of the weight plate.

As shown in FIG. 2, in this embodiment, the limiting part 3180 is provided with a plurality of limiting clamping grooves 3181, and the limiting clamping grooves 3181 are used for limiting the weight plates 1200, wherein at least part of the weight plates 1200 are located in the limiting clamping grooves 3181 when the weight plate selection mechanism 1300 locks the weight plates 1200.

Wherein, a plurality of limiting clamping grooves are arranged on the limit part. These clamping grooves are used to limit the weight plates and ensure that at least part of the weight plates can be located in the limiting grooves when the plate selection mechanism locks the weight plates. In this way, the weight plate is not easy to shift or fall off under the action of external force, which greatly improves the safety of the dumbbell in the use process.

In addition, the design of the limiting clamping groove also takes into account the diversity of weight plates. Weight plates with different weights may have different sizes and shapes, and the number and distribution of limiting clamping grooves can be adjusted as needed to adapt to weight plates with different specifications. This design makes dumbbells more flexible and adaptable when used.

The dumbbell provided by the present invention has a plurality of use scenarios, including but not limited to the following scenarios: the dumbbell is exquisite in design and stable in structure, and is suitable for daily strength training and muscle exercise of family users. Users can choose the appropriate weight of the weight plate for training according to their physical condition and exercise goals.

This dumbbell is an ideal choice for users who set up fitness corners or fitness areas at home. Its structure is compact, does not occupy too much space, and at the same time can meet a variety of exercise needs, such as squat, pulling, bending and so on.

Dumbbells are also very effective for rehabilitation training, such as joint rehabilitation and muscle recovery. In the family environment, users can carry out rehabilitation training under professional guidance and gradually recover their physical functions.

Dumbbells are one of the indispensable instruments in the strength training area of the gym. The structural design and functional characteristics of the dumbbell enable it to meet the needs of professional fitness coaches and fitness enthusiasts and carry out various high-intensity and difficult strength training.

Dumbbells are also commonly used in group courses in gymnasiums, such as circular training and aerobic strength courses. It is light and easy to use, which makes it convenient for coaches to demonstrate and guide and ensure the smooth progress of the course.

For gymnasiums that provide personal trainer services, dumbbells are one of the important tools for personal trainers to make personalized training plans for customers. The coach can choose the right dumbbell weight and training method according to the physical condition and exercise goal of the client.

What is claimed is:

1. A locking mechanism for a dumbbell, comprising:

a locking part and a locking groove arranged in a base, wherein the locking part is movably connected with the base; and the locking part comprises a locking member and a locking disk; and a rotating cavity and an accommodating cavity are arranged in the locking part; and the accommodating cavity has an elastic member inside and is provided with a first opening; and the accommodating cavity is communicated with the rotating cavity through the first opening; a first rotating shaft is arranged in the rotating cavity, and the locking disk is rotatably arranged on the first rotating shaft; and a second rotating shaft is arranged in the accommodating cavity, and the locking member is rotatably arranged on the second rotating shaft, wherein the first rotating shaft and the second rotating shaft are configured to be perpendicular to each other; and the locking disk comprises a plurality of locking protrusions and positioning grooves, and the locking member comprises a locking hook and a locking block, wherein at least part of the locking disk is located in the accommodating cavity through the first opening, and the locking block elastically abuts against the plurality of locking protrusions or the positioning grooves through the elastic member; and the locking hook is inserted into the locking groove and locks the locking part to the base.

2. The locking mechanism according to claim 1, wherein the accommodating cavity comprises an accommodating groove and an accommodating cover; the accommodating groove is arranged in the locking part, the accommodating cover is arranged to correspond to the shape of the accommodating groove and the accommodating cover is attached to the accommodating groove to form the accommodating cavity; and the first opening and a second opening are formed in the accommodating groove, wherein the first opening is a channel for the locking member and the locking disk to contact, and the second opening is a channel for the locking member and the locking groove to contact.

3. The locking mechanism according to claim 2, wherein at least one buckling protrusion is formed on the accommodating cover, and at least one buckling groove is formed in the accommodating groove; and the at least one buckling groove is engaged with the at least one buckling protrusion, and the accommodating cover and the locking part are detachably connected through the engagement between the at least one buckling protrusion and the at least one buckling groove.

4. The locking mechanism according to claim 3, wherein at least one embedding groove is formed in the accommodating groove, a first shaft clamping groove is formed on one side of the at least one embedding groove, and the first shaft clamping groove is set in a shape corresponding to the second rotating shaft; at least one embedded protrusion is formed in the accommodating cover, and the at least one embedded protrusion is set in a shape corresponding to the at least one embedding groove; and a second shaft clamping groove is formed on the at least one embedded protrusion, and the second shaft clamping groove corresponds to the first shaft clamping groove, wherein the second rotating shaft is arranged in the first shaft clamping groove and the second shaft clamping groove; and wherein, at least one rotating shaft hole and an elastic groove are arranged in the locking member, the at least one rotating shaft hole is communicated with the elastic groove; and the second rotating shaft passes through the at least one rotating shaft hole, and the elastic member is sleeved on the second rotating shaft, wherein the elastic member is located in the elastic groove.

5. The locking mechanism according to claim 1, wherein the base comprises a locking part groove for receiving the locking part, and the locking part groove is arranged in a shape corresponding to the locking part; and the locking groove is formed in the locking part groove, and an upper flange and a guide table are formed on a periphery of the locking groove; and the guide table is formed with a guide slope, and the guide slope declines toward the locking groove, wherein the guide table is used for guiding the locking hook into the locking groove, and the upper flange is used for clamping the locking hook.

6. A dumbbell comprising:

a dumbbell body, a base, and a locking mechanism arranged on the dumbbell body and the base, wherein the dumbbell body comprises a handle, a plurality of weight plates symmetrically arranged at two ends of the handle, and a plate selection mechanism; and the plate selection mechanism connects the handle to each of the weight plates of the plurality of the weight plates, and the plate selection mechanism locks all the weight plates by the rotation of the handle; and the locking mechanism comprises a locking part and a locking groove arranged in the base, wherein the locking part is movably connected with the base; and the locking part comprises a locking member and a locking disk; and a rotating cavity and an accommodating cavity are arranged in the locking part; and the accommodating cavity has an elastic member inside and is provided with a first opening; and the accommodating cavity is communicated with the rotating cavity through the first opening; and at least one first rotating shaft is arranged in the rotating cavity, the locking disk is rotatably arranged on the at least one first rotating shaft, and the locking disk rotates synchronously with the handle; and a second rotating shaft is arranged in the accommodating cavity, and the locking member is rotatably arranged on the second rotating shaft, wherein the at least one first rotating shaft and the second rotating shaft are configured to be perpendicular to each other; and the locking disk comprises a plurality of locking protrusions and positioning grooves, and the locking member comprises a locking hook and a locking block, wherein at least part of the locking disk is located in the accommodating cavity through the first opening, and the locking block elastically abuts against the plurality of locking protrusions or the positioning grooves through the elastic member; and the locking hook is inserted into the locking groove and locks the dumbbell body to the base.

7. The dumbbell according to claim 6, wherein the rotating cavity comprises a rotating groove and a rotating cover, the rotating groove is arranged in the locking part, and the rotating cover is arranged in a shape corresponding to the rotating groove and the rotating cover is attached to the rotating groove to form the rotating cavity; and an inscribed groove is formed in the rotating groove, wherein the plurality of locking protrusions of the locking disk and the positioning grooves are all arranged in the inscribed groove.

8. The dumbbell according to claim 6, wherein the dumbbell comprises a second first rotating shaft arranged at an opposing end of the handle, relative to the at least one first rotating shaft, another rotating cavity and another locking part having a respective locking member and a respective locking disk are provided on the same side of the handle as the second first rotating shaft wherein each of the rotating cavities comprises a respective rotating groove and a respective rotating cover, each of the rotating grooves is arranged in a respective locking part of the locking parts, and the each of the rotating covers is arranged in a shape corresponding to the respective rotating groove and each of the rotating covers is attached to the respective rotating groove to form the respective rotating cavity; and respective inscribed grooves are formed in the respective rotating grooves, wherein a plurality of locking protrusions of each of the locking disks and the respective positioning grooves are all arranged in the respective inscribed groove and an end of each of the at least one first rotating shaft and the second first rotating shaft facing away from the handle is provided with a respective rim part, a respective first part having a shape, a respective rotating part, and a respective second part having a shape in order from nearest to farthest from the handle.

9. The dumbbell according to claim 8, wherein, for each of the at least one first rotating shaft and the second first rotating shaft, a respective rim groove is formed at one end of the respective rotating cover facing away from the respective locking disk, and the respective rim groove is in a shape corresponding to the respective rim part, and the respective rim part is arranged in the respective rim groove; and a respective first driving groove is formed in the respective rim groove, and the respective first driving groove is in a shape corresponding to the shape of the respective first part, and the respective first part is arranged in the respective first driving groove; and a respective first limiting protrusion is formed on the respective first part, a respective first limiting groove is formed in the respective first driving groove, and the respective first limiting protrusion is arranged in the respective first limiting groove, wherein when the handle is rotated, the respective rotating cover and each of the at least one first rotating shaft and the second first rotating shaft rotate synchronously through the respective first driving groove, the respective first part, the respective first limiting protrusion and the respective first limiting groove.

10. The dumbbell according to claim 9, wherein, for each of the at least one first rotating shaft and the second first rotating shaft, a respective linkage block is arranged at one end of the respective rotating cover close to the respective locking disk, and a respective linkage hole is arranged on the respective locking disk; and the respective linkage block is arranged in the respective linkage hole, wherein when the respective rotating cover rotates, the respective rotating cover and the respective locking disk rotate synchronously through the respective linkage block and the respective linkage hole.

11. The dumbbell according to claim 10, wherein, for each of the at least one first rotating shaft and the second first rotating shaft, the locking part is provided with respective rotating holes corresponding to the shape of the respective rotating parts; and the respective rotating parts are arranged in the respective rotating holes, the respective rotating holes extend inward to form respective clamping protrusions, respective clamping grooves are formed on the respective rotating parts, and the respective clamping grooves are arranged in respective shapes corresponding to the respective clamping protrusions; and the locking part and each of the at least one first rotating shaft and the second first rotating shaft are rotatably connected through the clamping protrusion and the clamping groove.

12. The dumbbell according to claim 7, wherein the plate selection mechanism comprises a driving rod and a plurality of limiting disks, wherein the driving rod penetrates through the handle and is fixedly connected with the at least one first rotating shaft, and the plurality of limiting disks are arranged on the driving rod; and wherein a driving hole is arranged in a limiting disk of the plurality of limiting disks, the driving hole is arranged in a shape corresponding to the driving rod, and the driving rod is arranged in the driving hole.

13. The dumbbell according to claim 12, wherein at least one first plate selection bump and a first plate selection groove are arranged in each limiting disk, and at least one second plate selection bump and a second plate selection groove are arranged on each weight plate of the plurality of weight plates; and the at least one second plate selection bump is arranged in a shape corresponding to the first plate selection groove, and the second plate selection groove is arranged in a shape corresponding to the at least one first plate selection bump, and the masses of the plurality of weight plates are different, and the at least one first plate selection bump and the second plate selection groove in each limiting disk of the plurality of limiting disks are different in size; and when a weight plate of the plurality of weight plates is locked by the plate selection mechanism, the at least one first plate selection bump is arranged in the second plate selection groove, and the at least one second plate selection bump is arranged in the first plate selection groove.

14. The dumbbell according to claim 13, wherein a connecting part and a connecting groove are arranged on limiting disks of the plurality of limiting disks, the connecting groove of a first limiting disk of the limiting disks of the plurality of limiting disks is used for receiving the connecting part of a second limiting disk of the limiting disks of the plurality of limiting disks, and a second limiting protrusion is arranged on the connecting part; and a second limiting groove is arranged in the connecting groove, the second limiting groove is arranged in a shape corresponding to the second limiting protrusion, and the second limiting protrusion is arranged in the second limiting groove; and each limiting disk of the limiting disks of the plurality of limiting disks rotates synchronously through the connecting part, the connecting groove, the second limiting protrusion and the second limiting groove; and wherein one end of the limiting disk closest to the handle near the handle is provided with a second driving groove, and the second driving groove is arranged in a shape corresponding to a second part having a shape arranged in the second driving groove.

15. The dumbbell according to claim 12, wherein the base comprises a weight plate groove and a locking part groove, wherein the weight plate groove is used for accommodating the plurality of weight plates, and the locking part groove is used for accommodating the locking part; and the locking part groove is arranged in a shape corresponding to the locking part; and the locking groove is formed in the locking part groove, an upper flange and a guide table are formed at a periphery of the locking groove; and the guide table is formed with a guide slope, and the guide slope declines toward the locking groove, wherein the guide table is used for guiding the locking hook into the locking groove, and the upper flange is used for clamping the locking hook; and wherein an engaging strip is arranged in the weight plate groove, an engaging groove is arranged on the plurality of weight plates, and the engaging groove is arranged in a shape corresponding to the engaging strip, wherein when the plurality of weight plates are arranged in the weight plate groove, the engaging strip is located in the engaging groove.

16. The dumbbell according to claim 12, wherein a limiting part is arranged at one end of the locking part close to the dumbbell, one end of the limiting part being fixedly connected with the locking part, the other end of the limiting part being fixedly connected with a tail disk, and a through hole is arranged on the tail disk; and the through hole is shaped to accommodate the driving rod, the driving rod is rotatably arranged in the through hole, and the weight plates are arranged between the locking part and the tail disk; and wherein a plurality of limiting clamping grooves are arranged on the limiting part, and the plurality of limiting clamping grooves are used for limiting the plurality of weight plates, wherein when the plurality of weight plates are locked by the plate selection mechanism, at least part of the weight plates are located in the plurality of limiting clamping grooves.

17. The dumbbell according to claim 6, wherein the accommodating cavity comprises an accommodating groove and an accommodating cover; and the accommodating groove is arranged in the locking part, the accommodating cover is arranged to correspond to the shape of the accommodating groove and the accommodating cover is attached to the accommodating groove to form the accommodating cavity; and the first opening and a second opening are formed in the accommodating groove, wherein the first opening is a channel for the locking member and the locking disk to contact, and the second opening is a channel for the locking member and the locking groove to contact.

18. The dumbbell according to claim 17, wherein at least one buckling protrusion is formed on the accommodating cover, and at least one buckling groove is formed in the accommodating groove; and the at least one buckling groove corresponds to the at least one buckling protrusion, and the accommodating cover and the locking part are detachably connected through the at least one buckling protrusion and the at least one buckling groove.

19. The dumbbell according to claim 18, wherein at least one embedding groove is formed in the accommodating groove, a first shaft clamping groove is formed on one side of the at least one embedding groove, and the first shaft clamping groove is set in a shape corresponding to the second rotating shaft; and at least one embedded protrusion is formed in the accommodating cover, and the at least one embedded protrusion is set in a shape corresponding to the at least one embedding groove; and a second shaft clamping groove is formed on the at least one embedded protrusion, and the second shaft clamping groove corresponds to the first shaft clamping groove, wherein the second rotating shaft is arranged in the first shaft clamping groove and the second shaft clamping groove; and wherein at least one rotating shaft hole and an elastic groove are arranged in the locking member, the at least one rotating shaft hole is communicated with the elastic groove; and the second rotating shaft passes through the at least one rotating shaft hole, and the elastic member is sleeved on the second rotating shaft, wherein the elastic member is located in the elastic groove.

* * * * *